US006736500B2

(12) United States Patent
Takahashi et al.

(10) Patent No.: US 6,736,500 B2
(45) Date of Patent: May 18, 2004

(54) IMAGE FORMING METHOD AND APPARATUS THAT FORM AND TRANSFER IMAGE OF LIQUID DROPS OF INCREASED VISCOSITY

(75) Inventors: Tomoko Takahashi, Yokohama (JP); Aino Noguchi, Yokohama (JP); Mitsuo Hasebe, Tokyo (JP); Kiyoshi Tanikawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/742,367

(22) Filed: Dec. 22, 2000

(65) Prior Publication Data

US 2001/0022607 A1 Sep. 20, 2001

(30) Foreign Application Priority Data

| | | |
|---|---|---|
| Dec. 24, 1999 | (JP) | 11-367337 |
| Jan. 12, 2000 | (JP) | 2000-004019 |
| Jan. 14, 2000 | (JP) | 2000-007212 |
| Mar. 29, 2000 | (JP) | 2000-092528 |
| Apr. 7, 2000 | (JP) | 2000-107234 |
| Sep. 26, 2000 | (JP) | 2000-292891 |

(51) Int. Cl.[7] ..... B41J 2/01

(52) U.S. Cl. ..... 347/103; 347/104; 355/290; 399/272; 399/273; 399/313; 399/312

(58) Field of Search ..... 347/103, 104; 399/312, 313, 318, 297, 272, 273, 279, 281, 283, 284, 296, 237, 239, 225, 233, 232; 355/290

(56) References Cited

U.S. PATENT DOCUMENTS 5,057,871 A * 10/1991 Hirose et al. ..... 355/259
5,450,183 A * 9/1995 O'leary ..... 355/285
5,481,349 A * 1/1996 Satoh et al. ..... 355/290
6,334,040 B1 * 12/2001 Tanaka ..... 399/313

FOREIGN PATENT DOCUMENTS

| | | | |
|---|---|---|---|
| JP | 06126945 A | | 5/1994 |
| JP | 06293178 A | | 10/1994 |
| JP | 07082516 A | | 3/1995 |
| JP | 07089067 A | | 4/1995 |
| JP | 2743151 | | 5/1996 |
| JP | 11188858 A | | 7/1999 |
| JP | 11-188858 | * | 7/1999 |
| JP | 155481 A | * | 6/2000 |

* cited by examiner

*Primary Examiner*—Stephen D. Meier
*Assistant Examiner*—Ly T Tran
(74) *Attorney, Agent, or Firm*—Oblon, Spivak, McClelland, Maier & Neustadt, P.C.

(57) ABSTRACT

A method of forming an image includes causing a material, that increases a viscosity of liquid drops by contact with the liquid drops, to adhere to a transfer medium, causing a liquid drop to contact the material according to an image signal such that an image is formed with the liquid drop having been increased in viscosity by contact with the material, and transferring the image to a recording medium. The viscosity of the liquid drop when increased on the transfer medium by contact with the material is set such that the liquid drop adheres to the recording medium without being divided into a part remaining on the transfer medium and another part being transferred to the recording medium. By the above-described image forming method, good image transfer is realized and thereby an image having no blotting is obtained.

18 Claims, 11 Drawing Sheets

IMAGE FORMING METHOD AND APPARATUS THAT FORM AND TRANSFER IMAGE OF LIQUID DROPS OF INCREASED VISCOSITY

BACKGROUND OF THE INVENTION

1. Field of the Invention

The present invention relates to image forming methods and apparatus to inject a liquid drop including color material according to an image signal to form an image on a transfer medium, and more particularly relates to image forming methods and apparatus that transfer an image formed by liquid drops having been increased in viscosity onto a recording medium and that separate the recording medium from the transfer medium.

2. Related Art

Ink jet printers have become widely used with a recent improvement in the performance not only for a small volume recording but also for a large volume recording such as ones for use in an office or for incorporation in a production equipment. With such expansion of the field of use of ink jet printers, a demand has increased for recording an image on a sheet of high quality plain paper with less blotting. In ink jet printers, formation of an image on a sheet of plain paper without blotting has been one of most important technical challenges, demand for which has recently increased more than ever.

For formation of an image on a sheet of plain paper without blotting, various attempts have been made. In particular, a technology to transfer an image onto a sheet of plain paper used as a recording medium via a transfer medium has been regarded as one of the promising technologies, and developments of such a technology have been vigorously pursued.

For example, Japanese Patent Laid-open publications Nos. 6-293178 and 7-089067 describe methods of solving blotting of an image on a sheet of plain paper serving as a recording medium. In the methods, an image is once formed with ink jet liquid drops on a transfer medium, and the image is then transferred to a sheet of plain paper when the ink jet liquid drops have changed, through phase transition, for example by being heated, to have a viscosity suitable for being transferred.

However, in the methods described in the JP Laid-open publications No. 6-293178 and 7-089067, a surface active agent is adhered to the transfer medium in advance for increasing the wettability of a transfer medium. Therefore, it takes a certain time for liquid drops, forming an image on the transfer medium, to change to have a viscosity suitable for the transfer, for example by being heated, and the image on the transfer medium tends to blot during that time. In particular, blotting is remarkable in solid parts of an image. Because of such time for waiting for liquid drops to change to have a viscosity suitable for transfer, increasing the printing speed, for example in a line printer, is limited.

Further, for solving the above-described problem in the methods described in JP Laid-open publications 6-293178 and 7-89067, the applicant of the present invention has proposed in Japanese Patent Laid-open publication No. 11-188858 a method in which powder having an absorbing property is adhered onto a transfer medium and the viscosity of ink liquid drops forming an image on the transfer medium is increased by the powder being absorbed by the ink liquid drops in a short time. The ink liquid drops as an image are transferred to a sheet plain paper utilizing increased viscosity of the ink liquid drops, and thereby image blotting in the sheet of plain paper is avoided. This method enables instantly obtaining a clear image having less blotting on a sheet of plain paper. In particular, if liquid ink drops having increased viscosity can be completely transferred to a recording medium, necessity of cleaning a surface of the transfer medium is eliminated, and thereby the transfer mechanism can be simplified and earlier deterioration of the transfer medium can be prevented, which are convenient.

However, it has been revealed by the inventors of the present invention, through minute observation of an image transferred onto a recording medium, that even an image which appears to be satisfactory has some inferior parts. Specifically, a phenomenon has been revealed that some parts of an image, having been transferred onto a recording medium, are omitted due to insufficient viscosity of the image.

Further, in the methods of JP Laid-open publications Nos. 6-126945 and 7-82516 and JP No. 2743151 which use a transfer medium as in the method of JP Laid-open publication No. 11-188858, a problem is known that some parts of an image are not transferred when liquid drops forming the image, which have been increased in the viscosity, are not well caught in the fibers of a sheet of paper serving as a recording medium.

In addition to the above-described problem relating to viscosity of liquid drops, another problem is known that uneven image transfer occurs if contact between a sheet of paper and a transfer medium is insufficient when transferring an image.

Still furthermore, a problem is known that inadequate separation of a recording medium from a transfer medium remarkably influences the quality of a transferred image as in insufficient transfer of the image.

SUMMARY OF THE INVENTION

The present invention has been made in view of the above-discussed and other problems and addresses the above-discussed and other problems.

Accordingly, preferred embodiments of the present invention provide a novel image forming method and a novel image forming apparatus, in which good transfer of an image onto a recording medium from a transfer medium is achieved, ink liquid drops having been increased in the viscosity are sufficiently tangled with fibers of paper serving as the recording medium such that occurrence of partially uneven transfer of the image is avoided, and the performance of image fixing on the recording medium is improved.

Further, preferred embodiments of the present invention provide a novel image forming method and a novel image forming apparatus that achieve good contact between a recording medium and a transfer medium when transferring an image from the transfer medium to the recording medium, such that ink liquid drops having been increased in the viscosity are sufficiently tangled with fibers of paper serving as the recording medium, and thereby partially uneven image transfer is avoided and image fixing performance is improved.

Still furthermore, preferred embodiment of the present invention provide a novel image transfer method and a novel image transfer device that transfer an image to a recording medium from a transfer medium by pressing the recording medium to the transfer medium and that then smoothly separate the recording medium from the transfer medium.

According to a preferred embodiment of the present invention, a method of forming an image includes steps of causing a material, that increases a viscosity of liquid drops by contact with the liquid drops, to adhere to a transfer medium, causing a liquid drop to contact the material according to an image signal such that an image is formed with the liquid drop having been increased in viscosity by contact with the material, and transferring the image formed by the liquid drop having been increased in viscosity to a recording medium. Viscosity of a liquid drop when increased on the transfer medium by contact with the material is set such that the liquid drop adheres to the recording medium and such that the liquid drop is transferred to the recording medium without being divided into a part remaining on the transfer medium and another part being transferred to the recording medium. By the above-described image forming method, good image transfer is realized and thereby an image having no blotting is obtained.

According to the invention, in the above-described method, viscosity of a liquid drop when increased by contact with the material may be between 10,000 cps (centipoise) and 200,000 cps. By setting viscosity of a liquid drop when increased by contact with the material in such a range, an image of good quality is obtained.

Further, an interval of the material to adhere to the transfer medium may be made smaller than a diameter of the liquid drop when the liquid drop contacts the transfer medium. Thereby, it never occurs that some liquid drops are not increased in the viscosity, and therefore uneven transfer of an image is avoided.

Furthermore, in the step of causing the material to adhere to the transfer medium, the material may be formed into an aggregation that is movable in a lump before adhering to the transfer medium, and when the material adheres to the transfer medium, an interval of the material to adhere to the transfer medium may be made smaller than a diameter of the liquid drop when the liquid drop contacts the transfer medium. Thereby, because a sufficient amount of the material adheres to the transfer medium, even when an image is formed by a large amount of liquid drops, for example as when the image includes a solid part in which more than two colors are overlapped, apprehension for insufficient viscosity of the liquid drops is avoided. Further, because an adhering interval of the aggregations is smaller than a diameter of a liquid drop when the liquid drop contacts the transfer medium, it never occurs that some liquid drops are not increased in the viscosity. Thereby, uneven transfer of an image is more securely avoided.

According to another preferred embodiment of the present invention, an image forming apparatus includes a transfer medium, and a material forming device configured to cause a material, that increases a viscosity of liquid drops by contact with the liquid drops, to adhere to the transfer medium. An image forming device causes a liquid drop to contact the material according to an image signal such that an image is formed with the liquid drop having been increased in viscosity by contact with the material. A transfer device transfers the image formed with the liquid drop having been increased in viscosity onto a recording medium. A setting device sets viscosity of the liquid drop when increased on the transfer medium by contact with the material such that the liquid drop adheres to the recording medium and such that the liquid drop is transferred to the recording medium without being divided into a part remaining on the transfer medium and another part being transferred to the recording medium. Good image transfer is realized by the above-described image forming apparatus, so that a good image having no blotting is obtained.

According to the invention, in the above-described image forming apparatus, the viscosity setting device may be the material forming device. Thereby, the image forming apparatus is simplified.

Further, the material forming device may include a device configured to cause the material to adhere to the transfer medium at an interval smaller than a diameter of the liquid drop when the liquid drop contacts the transfer medium. Accordingly, it never occurs that some liquid drops are not increased in the viscosity, and thereby uneven transfer of an image is avoided.

Furthermore, the material forming device may further include an aggregation forming device configured to form the material into an aggregation that is movable in a lump, and when the material, after having been formed into the aggregation, is caused to adhere to the transfer medium, an interval of the material to adhere to the transfer medium may be set to be smaller than a diameter of the liquid drop when the liquid drop contacts the transfer medium. Thereby, because a sufficient amount of the material adheres to the transfer medium when the material is applied onto the transfer medium, even when an image is formed by a large amount of liquid drops, for example as when the image includes a solid part in which more than two colors are overlapped, apprehension for occurrence of insufficient viscosity of the liquid drops is avoided. Further, because an adhering interval of the aggregations is smaller than a diameter of a liquid drop when the liquid drop contacts the transfer medium, it never occurs that some liquid drops are not increased in the viscosity. Thereby, uneven transfer of an image is more securely avoided.

Still furthermore, the aggregation forming device may include a concave at a surface thereof facing the transfer medium and be configured to form the aggregation by containing the material in the concave. By making an interval of the concave portions smaller than a liquid drop diameter when the liquid drop contacts the transfer medium, an interval of the material to adhere to the transfer medium is securely made smaller than the liquid drop diameter.

Further, the aggregation forming device may be made of a urethane sponge, such that the construction is simplified and thereby the cost is reduced.

Further, the image forming apparatus may include in a vicinity of the aggregation forming device a device to make the aggregation uniform. Because the aggregation is made uniform by the device, occurrence of image blotting and penetration through a recording medium at some portions of an image is avoided, and thereby en extremely good image can be obtained.

According to another preferred embodiment of the present invention, an image forming apparatus includes a transfer medium, a material forming device configured to cause a material, that increases a viscosity of liquid drops by contact with the liquid drops, to adhere to the transfer medium, an image forming device configured to cause a liquid drop to contact the material according to an image signal such that an image is formed with the liquid drop having been increased in viscosity by contact with the material, and a transfer device configured to transfer the image formed with the liquid drop having been increased in viscosity onto a recording medium. The transfer device includes a transfer medium support device configured to support the transfer medium, and a recording medium support device configured to support the recording medium, and a hardness of the transfer medium support device is made different from a hardness of the recording medium support device. By making the transfer medium support device and the recording medium support device different in hardness, a transfer nip formed between the transfer medium support device and the recording medium support device is formed in a shape which is not flat, i.e., in a curved shape, and thereby the liquid drops forming an image on the transfer medium more closely contact a recording medium, such that uneven transfer of the image is hard to occur.

The transfer medium support device may be configured so as to convey the transfer medium and the recording medium support member may be configured so as to convey the recording medium. Thereby, the image forming apparatus may be simplified.

Alternatively, the transfer medium support device and the recording medium support device may be made different in diameters, or the transfer medium support device and the recording medium support device may include elastic members which are different in thickness. Thereby, the transfer nip is formed in a curved shape, such that uneven transfer of an image is similarly hard to occur.

According to another preferred embodiment of the present invention, an image transfer apparatus includes a transfer medium and a pressing device that is configured to press a recording medium brought in contact with the transfer medium such that the image is transferred onto the recording medium, for use in an image forming apparatus having a material forming device configured to cause a material, that increases a viscosity of liquid drops by contact with the liquid drops, to adhere to a transfer medium of the image transfer device and an image forming device configured to cause a liquid drop to contact the material according to an image signal such that an image is formed with the liquid drop having been increased in viscosity by contact with the material. A surface of the transfer medium and a surface of the pressing device are moved at different speeds, and the recording medium is moved by movement of the transfer medium. Because the pressing device causes a rubbing force to act on the recording medium being conveyed along the transfer medium, the recording medium closely contacts the transfer medium such that an image formed with liquid drops having been increased in viscosity is effectively pressed into paper fibers of the recording medium so as to be firmly entangled with the paper fibers. Accordingly, occurrence of partially inferior image transfer is avoided.

According to the invention, the surface of the pressing device may include fluorine resin. Thereby, when an image formed with liquid drops having been increased in viscosity is pressed by the pressing device so as to be effectively entangled with paper fibers of a recording medium, the pressing device and the recording medium slide smoothly relative to each other such that transfer performance is improved.

Further, the pressing device may be configured to stop when transferring an image. Thereby, construction of the transfer apparatus may be simplified. Further, shape of a portion of the pressing device contacting a recording medium can be freely determined and therefore it is relatively easy to realize a relatively wide nip width.

Furthermore, the pressing device may be configured so as to rotate and to move in a substantially same direction as the transfer medium when transferring an image. Thereby, resistance to a recording medium when the recording medium is conveyed in a downstream direction in a rotation direction of the transfer medium is small, so that the recording medium is securely conveyed. Also, insertion of a recording medium toward the pressing device (roller) is relatively easier than when the pressing device is at a standstill. Further, when a leading edge of a recording medium contacts either the pressing device or the transfer medium, a conveying force to convey the recording medium in a downstream direction in a transfer medium conveyance direction acts on the leading edge of the recording medium, so that insertion of the recording medium is facilitated.

Still furthermore, the transfer medium and the pressing device may be configured so as to be driven by a same driving device. Thereby, controlling the transfer medium and the pressing device to operate in a synchronized manner is facilitated. Accordingly, the transfer apparatus as described above may be effectively used in an image forming apparatus in which a transfer medium is intermittently driven or a moving speed of the transfer medium is changed according to a change of the operating mode.

Alternatively, by configuring the transfer medium and the pressing device so as to be driven by separate driving devices, adjustment of a relationship of moving speeds between the transfer medium and the pressing device is facilitated. The relationship can be controlled according to the recording medium, e.g., according to the kind of recording paper and thickness of the paper, or according to the environmental conditions, so that good image transfer is enabled.

According to another preferred embodiment of the present invention, an image forming apparatus includes a transfer medium, and a material forming device configured to cause a material, that increases a viscosity of liquid drops by contact with the liquid drops, to adhere to the transfer medium. An image forming device causes a liquid drop to contact the material according to an image signal such that an image is formed with the liquid drop having been increased in viscosity by contact with the material, and a transfer device transfers the image formed with the liquid drop having been increased in viscosity onto a recording medium. The transfer device is configured so as to form a transfer nip, where the image is transferred onto the recording medium, in a curved shape. Because the transfer nip is curved, a rubbing force is generated between the transfer medium and the recording medium, and thereby the recording medium closely contacts the transfer medium such that the image formed with the liquid drops having been increased in viscosity is effectively pressed into paper fibers of the recording medium so as to be firmly entangled with the paper fibers. Accordingly, occurrence of partially inferior image transfer is avoided.

According to another preferred embodiment of the present invention, a method of forming an image includes steps of causing a material, that increases a viscosity of liquid drops by contact with the liquid drops, to adhere to a transfer medium, causing a liquid drop to contact the material according to an image signal such that an image is formed with the liquid drop having been increased in viscosity by contact with the material, and transferring the image formed by the liquid drop having been increased in viscosity to a recording medium brought into contact with the transfer medium by pressing the recording medium with a pressing device. According to the invention, in the transferring step, surfaces of the transfer medium and the pressing device are moved at different speeds, and the recording medium is moved by movement of the transfer medium. Because the pressing device presses the recording medium at the side not contacting the image and rubs the recording medium, the contact of the pressing device and the recording medium is remarkably improved so that the image formed with the liquid drops having been increased in viscosity is effectively pressed into paper fibers of the recording medium so as to be firmly entangled with the paper fibers. Accordingly, occurrence of partially inferior image transfer is avoided.

According to another preferred embodiment of the present invention, a method of forming an image includes steps of causing a material, that increases a viscosity of liquid drops by contact with the liquid drops, to adhere to a transfer medium, causing a liquid drop to contact the material according to an image signal such that an image is formed with the liquid drop having been increased in viscosity by contact with the material, transferring the image formed by the liquid drop having been increased in viscosity to a recording medium, and separating the recording medium from the transfer medium. According to the invention, in the separating step the recording medium is separated by passing a curvature portion of the transfer medium. Thereby, the recording medium is securely separated from the transfer medium.

According to the invention, before the recording medium passes the curvature portion of the transfer medium, in the transferring step the image on the transfer medium and the recording medium are brought into contact with each other and are pressed so that the image is transferred to the recording medium. Accordingly, the image is securely transferred onto the recording medium, and further the recording medium is securely separated from the transfer medium.

According to another preferred embodiment of the present invention, an image forming apparatus includes a transfer medium, a material forming device configured to cause a material, that increases a viscosity of liquid drops by contact with the liquid drops, to adhere to the transfer medium, and an image forming device configured to cause a liquid drop to contact the material according to an image signal such that an image is formed with the liquid drop having been increased in viscosity by contact with the material. According to the invention, the transfer medium includes a transfer position to transfer the image formed with the liquid drop having been increased in viscosity onto a recording medium and a separation position to separate the recording medium from the transfer medium, and a curvature is formed in the transfer medium at the separation position of the transfer medium. Due to the curvature formed in the transfer medium at the separation position, the recording medium is securely separated from the transfer medium.

According to the invention, the radius of curvature formed in the transfer medium at the separation position is preferably between about 1.25 mm and about 15 mm, so that a recording medium can be securely separated from the transfer medium.

Further, the radius of curvature formed in the transfer medium at the separation position may be between about 1.25 mm and about 7 mm, so that a recording medium can be more securely separated from the transfer medium. Specifically, when a recording medium carries an image at a leading edge of the recording medium, the recording medium more firmly contacts the transfer medium as compared when the recording medium does not carry an image at a leading edge thereof. By making the curvature formed in the transfer medium at the separation position smaller, even in such a case, the recording medium can be securely separated from the transfer medium. Further, when an image forming apparatus is configured such that a blank part is formed at a leading edge of a recording medium for securely separating the recording medium from a transfer medium, by sufficiently examining a relationship between the transfer position of the transfer medium and the curvature formed in the transfer medium at the separation position, the blank part required at a leading edge of a recording medium can made less.

Further, a pressing device to press the transfer medium at the transfer position is provided upstream of the separation position of the transfer medium where the curvature is formed in the transfer medium, in a conveying direction of the recording medium. With provision of such a pressing device, good image transfer and good separation of a recording medium are both achieved.

Furthermore, when support members supporting the transfer medium at the transfer position and the separation position respectively include rollers, a radius of the roller supporting separating position may be made smaller than a radius of the roller supporting the transfer medium at the transfer position. In order to achieve good transfer of an image, a transfer nip for the transfer must be wide. Therefore, a roller having a relatively large diameter is used for the support member supporting the transfer medium at the transfer position. On the other hand, in order to achieve good separation of a recording medium from the transfer medium, a curvature formed in the transfer medium at the separation position must be small. Therefore, a roller having a relatively small diameter is used for the support member supporting the transfer medium at the transfer position. Thereby, both the image transfer performance and the reliability of separating a recording medium from the transfer medium have been improved.

Further, a support member supporting the transfer medium at the transfer position and a support member supporting the transfer medium at the separation position may be formed in an integral body. Thereby, while good image transfer and good separation of a recording medium are both achieved, the apparatus can be simplified.

Furthermore, a plurality of transfer positions may be provided, so that the image transfer performance is further enhanced.

Further, according to the invention, a support member supporting the transfer medium at the separation position and a support member supporting the transfer medium at the transfer position may be separate. Thereby, the image transfer performance and the separation performance of a recording medium can be respectively improved by individually optimizing a transfer nip formed by the support member supporting the transfer medium at the transfer position and a pressing device pressing a recording medium at the transfer position and a curvature formed in the transfer medium at the separation position by the support member supporting the transfer medium at the separation position.

According to another preferred embodiment of the present invention, an image forming apparatus includes a transfer medium, a material forming device configured to cause a material, that increases a viscosity of liquid drops by contact with the liquid drops, to adhere to the transfer medium, and an image forming device configured to cause a liquid drop to contact the material according to an image signal such that an image is formed with the liquid drop having been increased in viscosity by contact with the material. A transfer device is configured to transfer the image formed with the liquid drop having been increased in viscosity onto a recording medium, and a separation device is configured to separate the recording medium from the transfer medium. According to the invention, when the image forming apparatus is such that an image forming operation by the image forming device and an image transferring operation by the image transfer device are intermittently performed at a same time, a plurality of pressing devices for image transfer are arranged at an interval different from an integer times of an interval the transfer medium is intermittently moved. When an image forming apparatus is configured such that an image forming operation by an image forming device and an image transferring operation by an image transfer device are intermittently performed at a same time, uneven transfer of an image is caused in the image due to intermittent movement of the transfer medium. More particularly, when an image forming operation is performed by the image forming device for formation of an image on the transfer medium, the transfer medium stops while one line of the image is being formed, and after completion of one line of the image, the transfer medium is moved for formation of a next line of the image. Therefore, during that time when the transfer medium is stopped, a same portion of the image which is being transferred at a transfer position of the transfer medium continues to be pressed, and thereby is transferred differently from another portion of the image which has been transferred while the transfer medium is moving. By arranging a plurality of pressing devices at an interval different from an integer times of the interval the transfer medium is intermittently conveyed, the above-described uneven transfer of an image is avoided.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
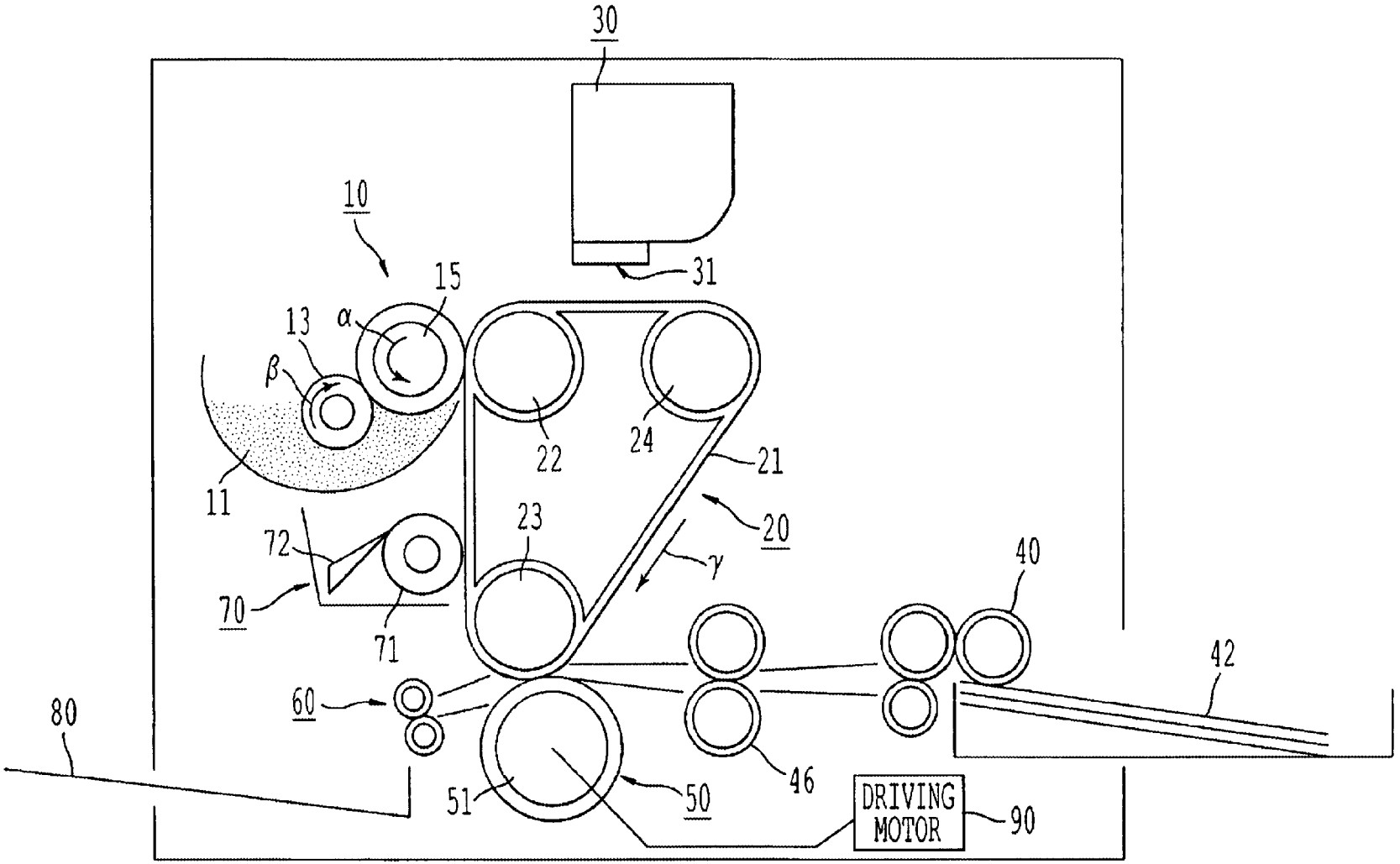
FIG. 1 is an explanatory diagram of an image forming apparatus to which the present invention is applied.

Referring now to the drawings, wherein like reference numerals designate identical or corresponding parts throughout the several views, preferred embodiments of the present invention are described.

FIG. 1 is an explanatory diagram of an image forming apparatus to which the present invention is applied. The image forming apparatus includes a powder applying device 10 serving as a material forming device, a transfer medium device 20, an ink jet recording device 30, a sheet feeding device 40, a transfer device 50, a sheet exhausting device 60 and a powder removing device 70.

In addition, FIG. 1 illustrates at least one driving motor 90 configured to drive the sheet feeding device 40 and the transfer roller 51 of the transfer device 50.

In the image forming apparatus, upon receiving a recording start signal, the powder applying device 10 applies powder 11 (hereinafter referred to as a set material) to an intermediate transfer belt 21 functioning as a transfer medium of the transfer medium device 20. More specifically, a driving force of a driving motor (not shown) of the set material (powder) applying device 10 is transmitted to a supplying/stirring roller 13 and an applying roller 15, and thereby the supplying/stirring roller 13 and the applying roller 15 are rotated in the directions indicated by an arrow α (alpha) and an arrow β (beta) in FIG. 1, respectively. The supplying/stirring roller 13 and the applying roller 15 contact with each other, and the set material 11 is transferred to the applying roller 15 from the supplying/stirring roller 13 and thereby the set material 11 is uniformly applied to the applying roller 15.

In parallel with the operation of the set material applying device 10, the transfer medium device 20 is also operated, and by contact of the applying roller 15 and the intermediate transfer belt 21, the set material 11 is applied onto the intermediate transfer belt 21. The set material 11 is powder of acrylic acid resins, acrylic acid/methacrylic acid polymers, methacrylic acid resins, or starch, which has a water absorption property and which has the particle diameter of about 0.5–20 μm. As the intermediate transfer belt 21, material which easily causes powder as the set material 11 to adhere to a surface of the intermediate transfer belt 21, such as silicone rubber, fluorine rubber, or chloroprene rubber, is used, and a thin layer of the set material 11 is formed on the intermediate transfer belt 21. The intermediate transfer belt 21 is supported by support rollers 22, 23 and 24, and is rotated in the direction indicated by an arrow γ (gamma).

After the set material 11 is applied onto the intermediate transfer belt 21, when a portion of the intermediate transfer belt 21 on which the powder (set material) 11 is applied moves to a position facing the ink jet recording device 30, a recording operation is started, and an image is recorded on the set material 11 on the intermediate transfer belt 21 with a liquid drop 31 injected by the recording device 30.

Figure 2:
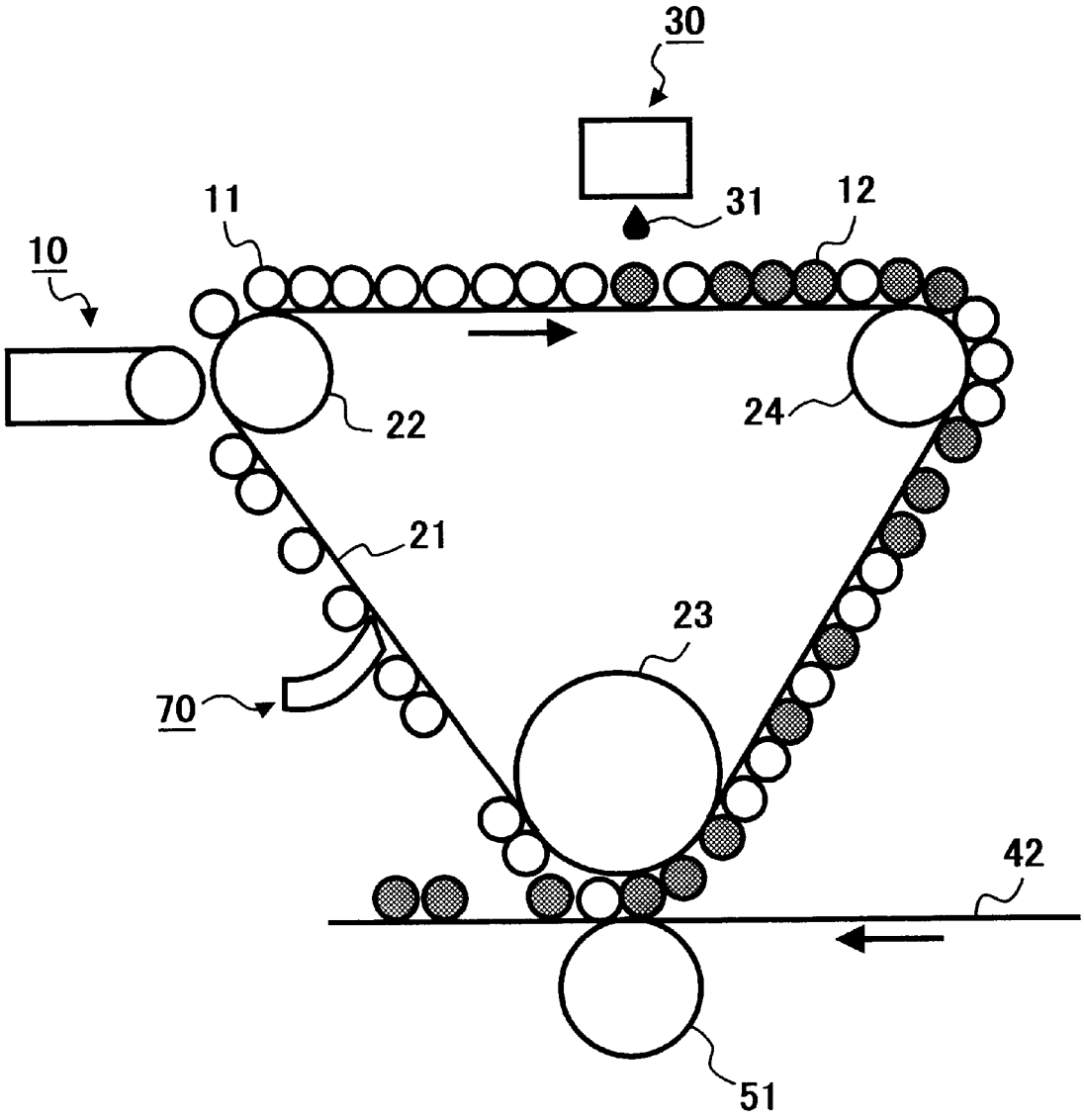
FIG. 2 is a schematic drawing which, for explaining an image forming method and an image forming apparatus according to a preferred embodiment of the present invention, illustrates relevant parts in FIG. 1 in different shapes.
Figure 3A:
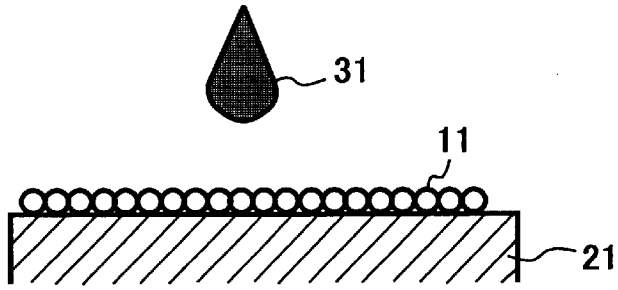
FIGS. 3(A)–3(E2) are diagrams for explaining a process of forming an image according to a preferred embodiment of the present invention.
Figure 3B:
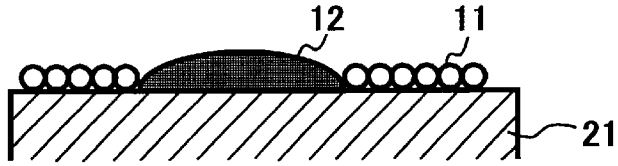

Aqueous ink serving as the liquid drop 31 absorbs powder serving as the set material 11 which is formed on the intermediate transfer belt 21 in a thin layer and changes to a gelled material 12 having a viscosity suitable for being transferred described later in reference to FIG. 2 and FIG. 3(B). While a recording is being performed or after the recording ends, a recording sheet serving as a recording medium 42 is fed out from the sheet feeding device 40, and an image on the intermediate transfer belt 21 is transferred onto the recording medium 42 by the transfer roller 51 and the support roller 23 of the transfer device 50. That is, the gelled material 12 formed in a shape of the image on the intermediate transfer belt 21 is sandwiched between the support roller 23 and the transfer roller 51 of the transfer device 50 via the recording medium 42, and by being pressed-contacted with the recording medium 42, the gelled material 12 as the image is completely transferred to the recording medium 42. Thereafter, the recording medium 42 is exhausted by the sheet exhaust device 60 so as to be stacked in a tray 80.

Because the intermediate transfer belt 21 is an elastic member of a silicone or fluorine family, the intermediate transfer belt 21 has a good releasing property relative to the gelled material 12, and the gelled material 12 hardly remains on the intermediate transfer belt 21.

At a portion of the intermediate transfer belt 21, from where the gelled material 12 as an image has been transferred to the recording medium 42, a surface of the intermediate transfer belt 21 is exposed, and at a portion of the intermediate transfer belt 21 which has not been used for formation of the image, a thin layer of the set material 11 remains. For a next recording, a thin layer of the set material 11 needs to be formed again on the intermediate transfer belt 21. Because the surface characteristics of the set material 11 remaining on the intermediate transfer belt 21 does not greatly change in a short time, by applying the set material 11 again onto the surface of the intermediate transfer belt 21 with the set material applying device 10, a thin layer of the set material 11 can be formed again on the intermediate transfer belt 21.

However, when the apparatus has not been used for a long time, the set material 11 on the intermediate transfer belt 21 may have absorbed humidity in the air and thereby the viscosity of the set material 11 may have been increased. It is not desirable to use such a set material 11 having an increased viscosity for image formation, and the set material 11 having the increased viscosity must be removed from the intermediate transfer belt 21, for which a cleaning device functioning as the set material removing device 70 is arranged. A cleaning roller 71 of the set material removing device 70 is made of a material which has smoothness of a metal surface or a resin coated surface and which has a relatively low releasing property, and removes the set material 11 having an increased viscosity from the intermediate transfer belt 21. The removed set material 11 is recovered from the surface of the cleaning roller 71 by a scraper 72 of the set material removing device 70. The intermediate transfer belt 21 from which a deteriorated set material 11 has been removed is coated again with the set material 11 so as to form a thin layer of the set material 11 over the entire surface of the intermediate transfer belt 21. Thereby, the intermediate transfer belt 12 is put in a condition for use again.

Now, referring to FIG. 2 and FIGS. 3(A)–3(E2), the present invention will be described more in detail. FIG. 2 is a schematic drawing which, for explaining an image forming method and an image forming apparatus according to a preferred embodiment of the present invention, illustrates relevant parts in FIG. 1 in different shapes. In FIG. 2, the parts having substantially the same functions as in FIG. 1 are denoted by same reference numerals, and the operations are substantially the same as those described with reference to FIG. 1. FIGS. 3(A)–3(E2) are diagrams for explaining a process of forming an image according to a preferred embodiment of the present invention.

Figure 3C:
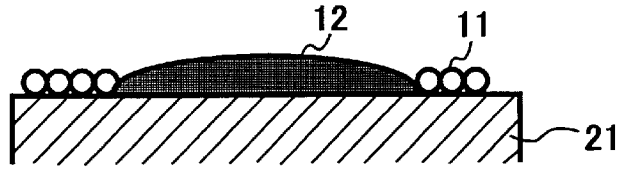

FIG. 3(A) illustrates a state in which the liquid drop 31 injected according to an image signal and including a color material corresponding to image information reaches the intermediate transfer belt 21, on which the set material 11 has been applied in advance. The set material 11 is powder having a solubility or a swelling property relative to the liquid drop 31. The set material 11 increases a viscosity of the liquid drop 31 by contact with the liquid drops 31. The liquid drop 31 immediately dissolves or swells the set material 11 upon reaching the intermediate transfer belt 21, and changes to the gelled material 12. The viscosity of the liquid drop 31 increases as a result that the liquid drop 31 is entangled with a molecule of the set material 11 which has reacted to water, and that water evaporates from the surface of the liquid drop 31. When the liquid drop 31 changes to the gelled material 12 upon reaching the intermediate transfer belt 21, the liquid drop 31 spreads over a surface of the intermediate transfer belt 21 as illustrated in FIG. 3(B). The spreading degree of the liquid drop 31 depends on an affinity between the liquid drop 31 and the set material 11 and an affinity between the liquid drop 31 and the intermediate transfer belt 21. As the viscosity of the liquid drop 31 increases, the spreading of the liquid drop 31 stops, as illustrated in FIG. 3(C).

Figure 3D:
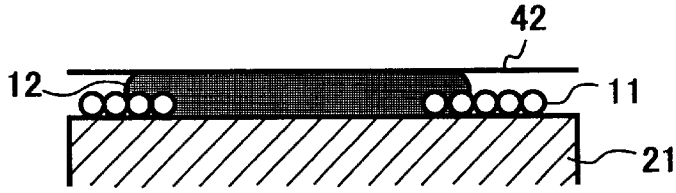
Figure 3D:
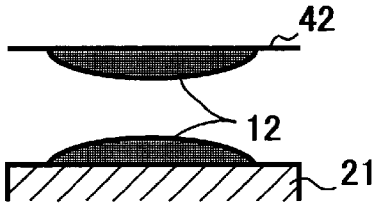
Figure 3D:
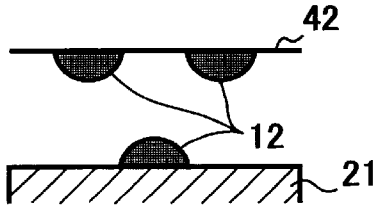

The liquid drop 31 having increased in the viscosity and changed to the gelled material 12 is liquidized by applying a stress thereto by press-contacting the recording medium 42 as illustrated in FIG. 3(D), so that the gelled material 12 as an image is transferred to the recording medium 42, e.g., a sheet of paper. At this time, if the set material 11 previously applied onto the intermediate transfer belt 21 is less than the liquid drop 31, when the gelled material 12 as an image is transferred to the recording medium 42, the gelled material 12 is separated, and as illustrated in FIG. 3(E1), a portion of the gelled material 12 remains on the intermediate transfer belt 21. This is because the density of the set material 11 in the liquid drop 31 is relatively low and thereby the cohesive power of the liquid drop 31 as a result of being entangled with a molecule of the set material 11 is not large.

On the other hand, if the set material 11 applied onto the intermediate transfer belt 21 is more than the liquid drop 31, the gelled material 12 is not transferred at all at some portions of the recording medium 42, thereby causing a blank in a transferred image as illustrated in FIG. 3(E2). This is because contact between the liquid drop 31 and the recording medium 42 is not good and thereby the cohesive power between the liquid drop 31 and the recording medium 42 does not act sufficiently.

Furthermore, depending upon the kind of the set material 11, even when the quantity of the set material 11 and the quantity of the liquid drop 31 are equal, a good transfer may not be achieved.

The inventors of the present invention have recognized that, for realizing a good transfer of the gelled material 12 onto the recording medium 42 in a stable manner so as to obtain a good image, it is important to optimize the viscosity of the gelled material 12 as the image after the set material 11 and the liquid drop 31 contact with each other and before transfer of the image to the recording medium 42.

Figure 4:
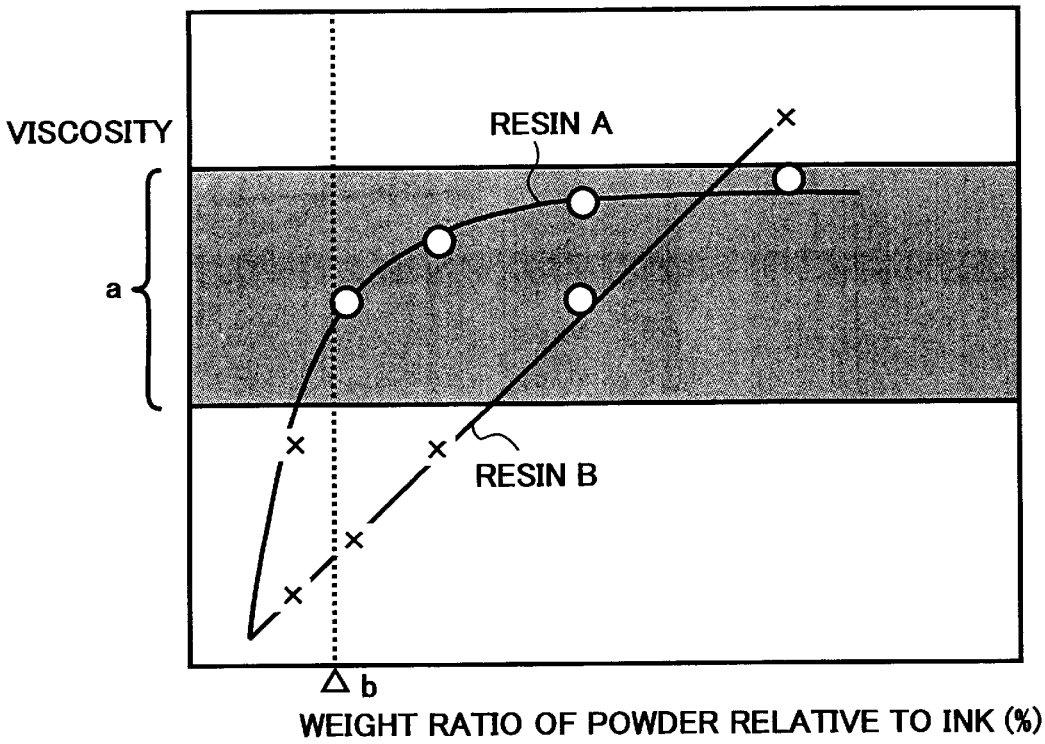
FIG. 4 is a graph indicating a result of evaluating the transfer performance and the viscosity of two kinds of a set material, resin A and resin B, when the weight ratio of the set material relative to a liquid drop is changed.

FIG. 4 is a graph indicating a result of evaluating the image transfer performance and the viscosity of two kinds of the set material 11, resin A and resin B, when the weight ratio of the set material 11 relative to the liquid drop 31 is changed. In FIG. 4, the horizontal axis represents the weight ratio (%) of the set material 11 relative to the liquid drop 31 and the vertical axis represents the viscosity of the gelled material 12 as an image. The result of evaluating the image transfer performance is indicated by a mark at each plotted point. A circle (o) indicates that a good image transfer was observed and a cross (x) indicates that an inferior image transfer was observed.

When the weight ratio (%) of the set material 11 relative to the liquid drop 31 is at a point indicated by "b", the resin A demonstrates a good image transfer and the resin B demonstrates an inferior image transfer. That is, the image transfer performance is not determined by the weight ratio (%) of the set material 11 relative to the liquid drop 31.

On the other hand, from the view point of the viscosity of the gelled material 12 as an image and the transfer performance of the image, it can be said that a good image transfer is possible when the viscosity is in the range of "a". When the viscosity is below the range "a", the liquid drop 31 and the set material 11 does not move as one body toward the recording medium 42 and thereby a portion of the gelled material 12 (the liquid drop 31 and the set material 11) remains on the intermediate transfer belt 21. When the viscosity is above the range "a", the cohesive power relative to the recording medium 42 does not act sufficiently and the gelled material 12 is not transferred at all to the recording medium 42 at some portions of the intermediate transfer belt 21.

According to a result of an experiment, a suitable viscosity range of the liquid drop 31 is between 10,000 cps and 200,00 cps when the viscosity of the liquid drop 31 has been increased by contact with the set material 11. In particular, the range between 50,000 cps and 100,000 cps is most suitable. When the viscosity is lower than 10,000 cps, the liquid drop 31 and the set material 11 do not move as one body toward the recording medium 42 and thereby a portion of the gelled material 12 (the liquid drop 31 and the set material 11) remains on the intermediate transfer belt 21. When the viscosity is higher than 200,000 cps, the cohesive power relative to the recording medium 42 does not act sufficiently and thereby the gelled material 12 is not transferred at all to the recording medium 42 at some portions of the intermediate transfer belt 21. Further, it was found that when the recording medium 42 has a water absorption property as paper has, a good transfer is possible even if the viscosity of an image is relatively low, and when the recording medium 42 does not have a water absorption property as metal does not have, a good transfer is achieved when the viscosity is relatively high.

As resin having the characteristics of the resin A, polyacrylic acid and poly-N-vinylacetoamide are known, and as resin having the characteristics of the resin B, polyacrylamide is known. It was further found out that when polyacrylic acid is used for the set material 11, a suitable viscosity range is obtained in a relatively wide range of the weight ratio (%) of the set material 11 relative to the liquid drop 31. It was found in particular that a good image is obtained in a stable manner in a wide range of the weight ratio (%) of the set material relative to the liquid drop 31.

Figure 5A:
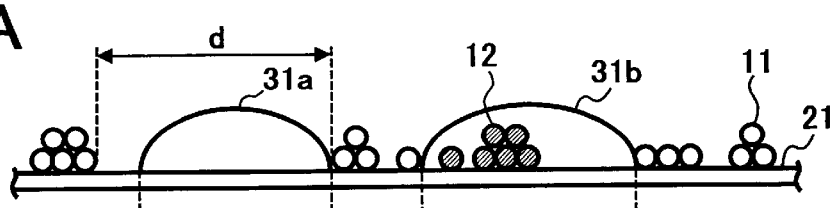
FIGS. 5(A)–5(C) are diagrams for explaining a relationship between a density of the set material applied onto an intermediate transfer belt and a liquid drop, FIG. 5(A) illustrating a state of the intermediate transfer belt before transferring the liquid drop, FIG. 5(B) illustrating a state of a recording sheet as a recording medium after transfer of the liquid drop thereupon, and FIG. 5(C) illustrating a state of the intermediate transfer belt after the transfer.
Figure 5B:
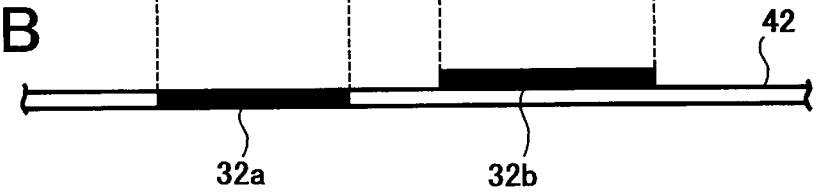
Figure 5C:
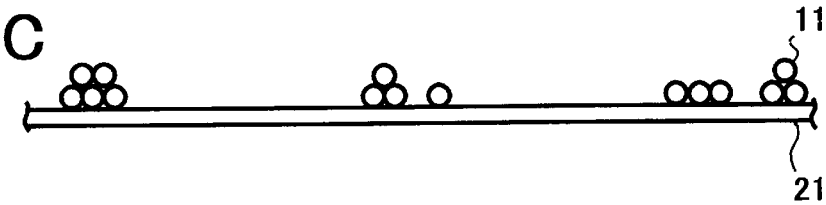

Next, referring to FIGS. 5(A)–5(C), a preferred embodiment of the set material applying device 10 configured so as to achieve a suitable viscosity range of the liquid drop 31 as described above is described. The parts having substantially the same functions as in FIG. 1 are denoted by same reference numerals, and the operations are substantially the same as those described with reference to FIG. 1. FIG. 5(A) illustrates a state of the intermediate transfer belt 21 before transferring the gelled material 12 as an image, FIG. 5(B) illustrates a state of a recording sheet as the recording medium 42 after transfer of the image, and FIG. 5(C) illustrates a state of the intermediate transfer belt 21 after the transfer.

In FIG. 5(A), liquid drops of ink recorded as images on the intermediate transfer belt 21 are denoted by numerals 31*a* and 31*b*. A distance "c" indicates a diameter of the ink liquid drop 31 when the liquid drop 31 has adhered onto the intermediate transfer belt 21, and a distance "d" indicates an interval of applying the set material 11 on the intermediate transfer belt 21. As illustrated in FIG. 5(A), the ink liquid drop 31*a* is recorded on a part of the intermediate transfer belt 21 where the distance "d", i.e., the interval between the set materials 11, is relatively wide, and thereby the liquid drop 31*a* does not contact the set material 11. Therefore, the viscosity of the liquid drop 31*a* is not increased. On the other hand, the ink liquid drop 31*b* is recorded on a part of the intermediate transfer belt 21 where the set material 11 exists thereupon. Therefore, the liquid drop 31*b* contacts the set material 11 and thereby the viscosity of the liquid drop 31*b* is increased.

FIG. 5(B) illustrates the recording medium 42 on which the ink liquid drops 31*a* and 31*b* are transferred. In FIG.

5(B), an image formed by transfer of the ink liquid drop 31*a* is denoted by numeral 32*a* and an image formed by transfer of the ink liquid drop 31*b* is denoted by numeral 32*b*. Because the image 32*a* is formed by transfer of the liquid drop 31*a* which has not been increased in the viscosity, by contact with a sheet of paper serving as the recording medium 42, the image 32*a* is absorbed into the sheet of paper. As a result, the image 32*a* blots and penetrates through the sheet of paper. On the other hand, the image 32*b* is formed by transfer of the liquid drop 31*b* which has been increased in the viscosity. Therefore, the image 32*b* adheres to a surface of the recording medium 42, so that the image 32*b* does not blot nor penetrate thorough a sheet of paper serving as the recording medium 42. Thus, an image of good quality is obtained. Because the intermediate transfer belt 21 has a good releasing property at its surface even relative to a liquid drop which has not been increased in the viscosity, the liquid drop 31*a* which has not been increased in the viscosity can be transferred to the recording medium 42. However, as illustrated in FIG. 5(B), the image 32*a* formed by transfer of the liquid drop 31*a* is absorbed into the recording medium 42 and thereby the image 32*a* blots the recording medium 42.

Such an image blotting problem has not been manifested in evaluating an image transfer performance in the past. However, while the inventors of the present invention were working for improving the image quality, the inventors have recognized an image blotting as described above in minute portions of an image, and a method of avoiding occurrence of such an image blotting has been demanded.

According to the present invention, for avoiding occurrence of a state where a liquid drop does not contact the set material 11 and thereby the liquid drop is not increased in the viscosity, a relationship between the liquid drop diameter "c" and the powder (set material) applying interval "d" is made so as to satisfy a relation, c>d.

As described above, because the intermediate transfer belt 21 has a good releasing property at its surface even relative to a liquid drop which has not been increased in the viscosity, the liquid drop 31*a* which has not been increased in the viscosity can be transferred to the recording medium 42. After the transfer, the image 32*a* is absorbed into the recording medium 42 as illustrated in FIG. 5(B), thus causing an image blotting and penetration through the recording medium 42. However, when the liquid drop 31 is increased in the viscosity as the liquid drop 31*b*, the liquid drop 31*b* adheres to a surface of the recording medium 42, and thereby an image blotting and penetration through the recording medium 42 does not occur. Thus, by making the powder (set material) applying interval "d" on the intermediate transfer belt 21 smaller than the liquid drop diameter "c" when the liquid drop 31 contacts the intermediate transfer belt 21, occurrence of a state where the liquid drop 31 does not contact the set material 11 and thereby the liquid drop 31 is not increased in the viscosity is avoided, and thereby an image blotting and penetration through the recording medium 42 is avoided.

Figure 6:
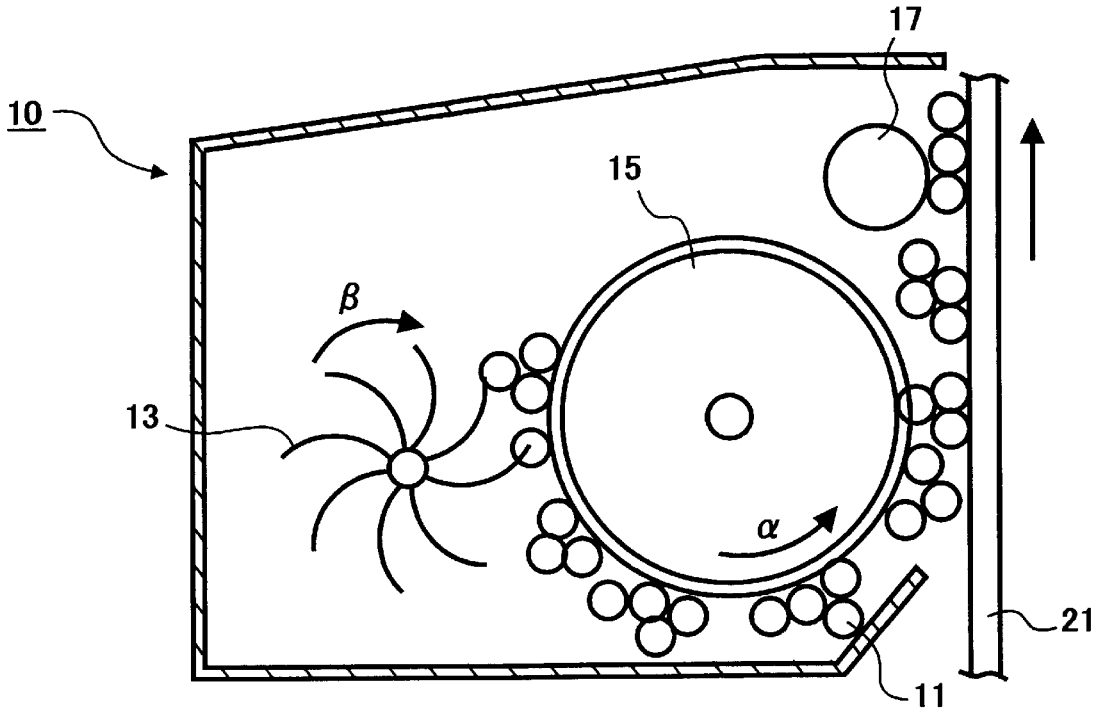
FIG. 6 is a schematic drawing illustrating an exemplary construction of a set material applying device according to a preferred embodiment of the present invention.

FIG. 6 is a schematic drawing illustrating an exemplary construction of the set material applying device 10 according to a preferred embodiment of the present invention, in which the above-described method of avoiding an image blotting and penetration problem is adapted. The parts having substantially the same functions as in FIG. 1 are denoted by same reference numerals, and the operations are substantially the same as those described with reference to FIG. 1. The surface of an applying roller 15 is made of EPDM, and is made coarse for conveying the set material 11. The applying roller 15 performs substantially the same function as described in reference to FIG. 1. A supplying/stirring brush is denoted by numeral 13 and performs the same functions as the supplying/stirring roller 13 in FIG. 1. The applying roller 15 and the supplying/stirring brush 13 rotate in the directions α, β, respectively. The intermediate transfer belt 21 is made of silicone rubber and has an adhesive power relative to the set material 11 at its surface. The set material 11 on the applying roller 15 is applied onto a surface of the intermediate transfer belt 21 by the cohesive power of the intermediate transfer belt 21. A unifying roller 17 contacts the intermediate transfer belt 21 so as to be rotated by rotation of the intermediate transfer belt 21. The unifying roller 17 performs a function of making the applying interval "d" of the set material 11 on the intermediate transfer belt 21 smaller than the diameter "c" of the liquid drop 31 when the liquid drop 31 contacts the intermediate transfer belt 21.

In an experiment, when the unifying roller 17 was not used, an image blotting and penetration through the recording medium 42 was observed in some portions of an image, and when the unifying roller 17 was used, an image blotting and penetration through the recording medium 42 was not observed in an image. Further, when a state of the set material 11 on the intermediate transfer belt 21 was observed by a microscope, the adhering interval of the set material 11 on the intermediate transfer belt 21 was more than 100 μm at the widest point when the unifying roller 17 was not used, and when the unifying roller 17 was used, the adhering interval was about 30 μm.

Figure 7:
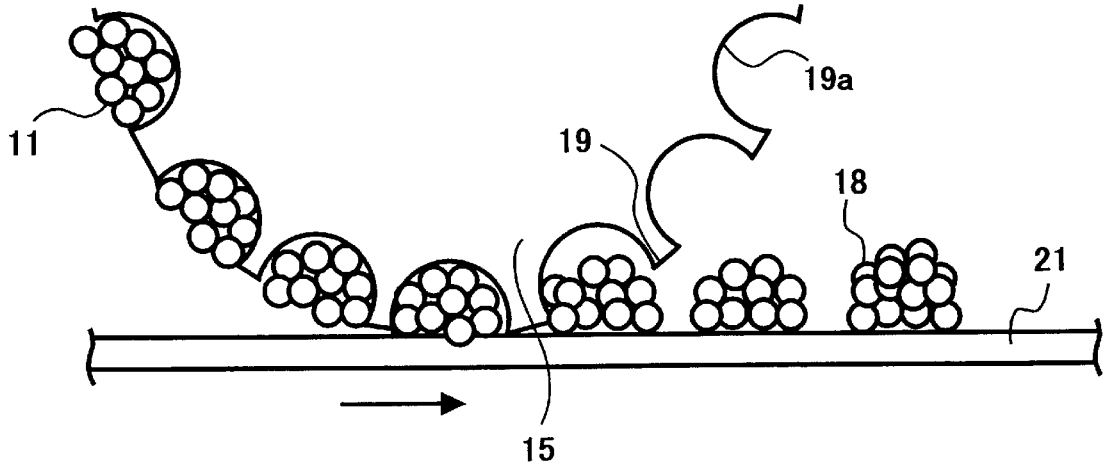
FIG. 7 is an enlarged drawing illustrating a construction of the main part of an applying roller functioning as an aggregation forming device according to a preferred embodiment of the present invention.

FIG. 7 is an enlarged drawing illustrating a construction of the main part of the applying roller 15 functioning as a aggregation forming device 19. A concave 19*a* is formed on an outer circumferential surface of the applying roller 15 at a predetermined interval in a circumferential direction. The set material 11 caught in the concave 19*a* is formed into an aggregation 18, and is then applied onto a surface of the intermediate transfer belt 21. The aggregation forming device 19 is formed, for example, with a urethane sponge. The diameter of the concave 19*a* is for example about 20 μm.

Figure 8A:
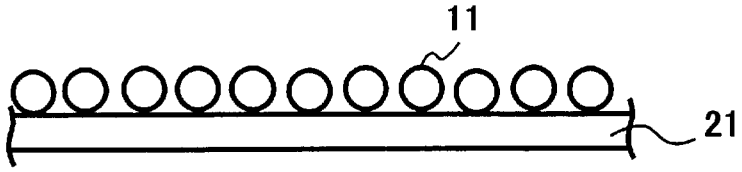
FIGS. 8(A)–8(E) are diagrams for explaining how the set material on an intermediate transfer belt serving as a transfer medium changes during an operation of an image forming apparatus.
Figure 8B:
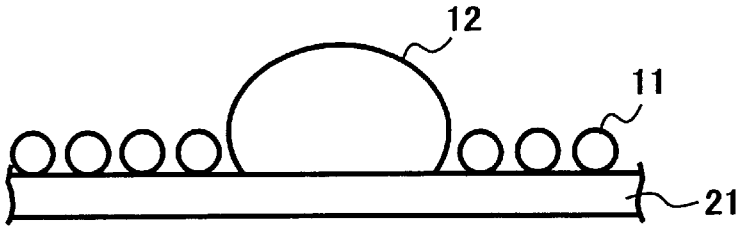
Figure 8C:
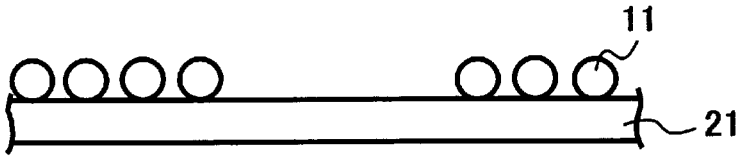
Figure 8D:
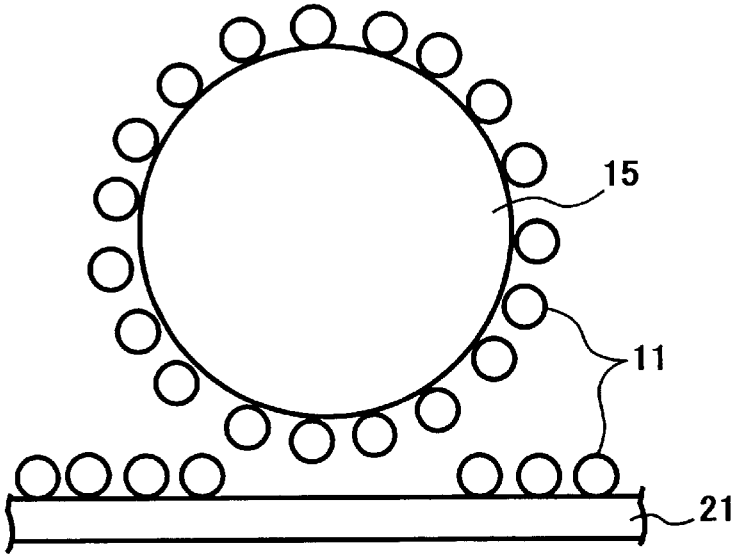
Figure 8E:
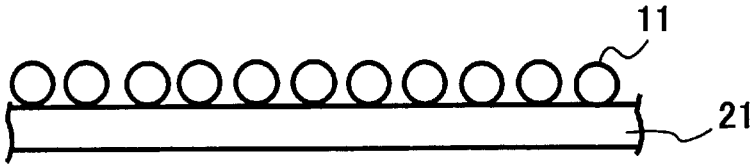

Next, a transfer device according to a preferred embodiment of the present invention is described. FIGS. 8(A)–8(E) are diagrams for explaining how the set material 11 on the intermediate transfer belt 21 serving as a transfer medium changes during an operation of an image forming apparatus. FIG. 8(A) illustrates a state of the intermediate transfer belt 21 on which the set material 11 is uniformly applied. FIG. 8(B) illustrates a state of the intermediate transfer belt 21 when an image is formed on the set material 11 applied on the intermediate transfer belt 21 by a liquid drop injected by an ink jet recording device (not shown). The liquid drop and the set material 11 react with each other and thereby the liquid drop is increased in the viscosity so as to be formed in a gelled material 12 as the image. FIG. 8(C) illustrates a state of the intermediate transfer belt 21 after the image of the gelled material 12 is transferred onto a sheet of paper serving as the recording medium 42. The portion of the intermediate transfer belt 21 where the image has existed is exposed as the image has been transferred to the sheet of paper. FIG. 8(D) illustrates a state of the intermediate transfer belt 21 when a layer of the set material 11 is formed again by applying the set material 11 again onto the exposed portion of the intermediate transfer belt 21. FIG. 8(E) illustrates a state of the intermediate transfer belt 21 on which the set material 11 has been applied again.

Figure 9:
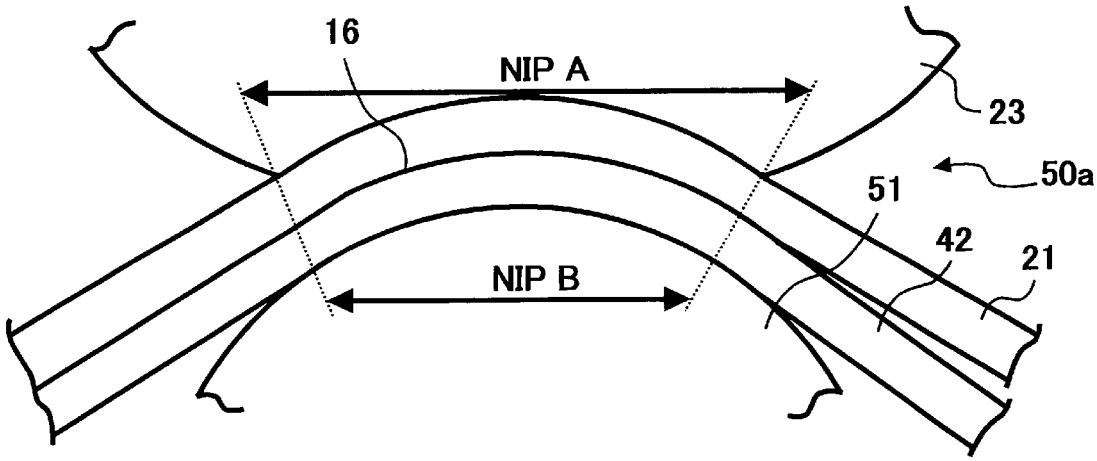
FIG. 9 is a diagram illustrating a state of a transfer nip of a transfer device, which is formed in a curved shape, according to a preferred embodiment of the present invention.

FIG. 9 is a diagram illustrating a transfer device 50 realizing an image transfer process illustrated in FIG. 8(C), and illustrates in particular a state of a transfer nip 50*a* of the transfer device 50. In FIG. 9, the transfer nip 50*a* is formed by a transfer roller 51 and a support roller 23, sandwiching therebetween a recording medium 42 and the intermediate transfer belt 21 serving as a transfer medium. In this embodiment, the hardness of the transfer roller 51 is made harder than that of the support roller 23, and therefore the transfer nip 50*a* is formed in a curved shape having an upward convex. In this case, a length of the transfer nip 50*a* at the side of the intermediate transfer belt 21 is indicated by a nip distance A and is different from a length of the transfer nip 50*a* at the side of the transfer roller 51, which is indicated by a nip distance B. A difference between the above two transfer nips is compensated by the gelled material 12 having a weakest cohesive power. That is, a force is applied to the gelled material 12 in a lateral direction centralized on the gelled material 12 and thereby entanglement of the gelled material 12 with paper fibers of the recording medium 42 is accelerated. Thus, when the shape of a transfer nip is not flat, ink liquid drops more firmly adhere to the recording medium (paper) 42, such that uneven transfer of an image is hard to occur.

Because FIG. 9 exaggeratedly illustrates a thickness of the intermediate transfer belt 21 and that of the recording medium 42, the difference between the transfer nip distance A and the transfer nip distance B may appear large. However, because the intermediate transfer belt 21 and the recording medium 42 are relatively thin when compared with the diameter of the transfer roller 51, the difference is very little. Accordingly, while an effect in enhancing the entanglement of the gelled material 12 with paper fibers of the recording medium 42 is large, the difference in the transfer nip distances A and B is not so large as to affect the quality of an image.

Figure 10A:
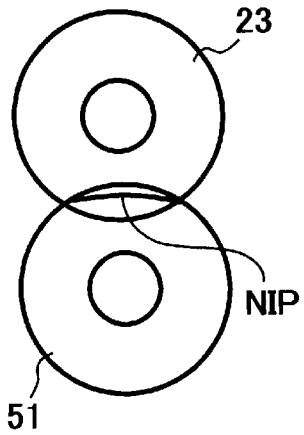
FIGS. 10(A)–10(C) are diagrams respectively illustrating exemplary transfer devices in which a transfer nip is curved.
Figure 10B:
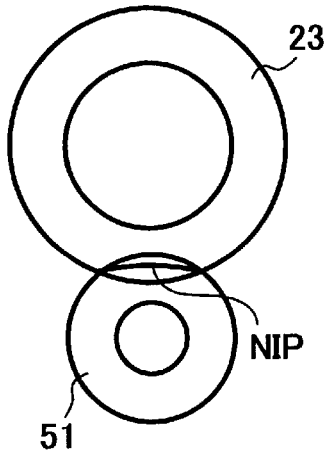
Figure 10C:
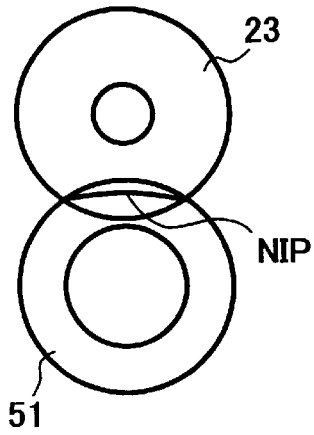

FIGS. 10(A)–10(C) are diagrams illustrating examples of the transfer device 50 according to preferred embodiments of the present invention, in which transfer nips are curved. FIG. 10(A) illustrate a case in which a hardness of the support roller 23 supporting the intermediate transfer belt 21 and that of the transfer roller 51 supporting the recording medium 42 are made different. FIG. 10(*b*) illustrates a case in which a diameter of the support roller 23 and that of the transfer roller 51 are made different. FIG. 10(C) illustrates a case in which a thickness of an elastic member of the support roller 23 and that of an elastic member of the transfer roller 51 are made different. In each of the above cases, the transfer nip is formed in a curved shape such that uneven transfer of an image can be avoided.

Figure 11:
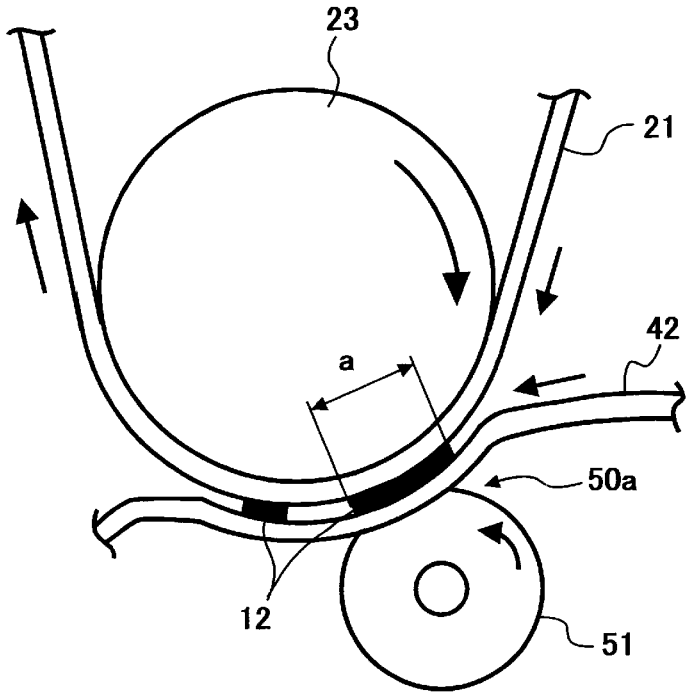
FIG. 11 is a schematic drawing for explaining another example of a transfer device in which a transfer medium and a pressing device pressing a recording medium to the transfer medium are moved at different speeds according to a preferred embodiment of the present invention.

FIG. 11 is a schematic drawing for further explaining the transfer device 50 according to a preferred embodiment of the present invention. Numeral 21 denotes an intermediate transfer belt made of silicone rubber, serving as a transfer medium, numeral 23 denotes a metal roller serving as a support roller to support the intermediate transfer belt 21, numeral 51 denotes a rubber roller serving as a pressing device, numeral 12 denotes an image whose viscosity has been increased, and numeral 42 denotes a recording sheet serving as a recording medium. The recording sheet 42 fed by a registration roller (not shown) is conveyed along the intermediate transfer belt 21 synchronized with a timing that the image on the intermediate transfer belt 21 moves to a transfer part 50*a* of the transfer device 50. The image 12 is transferred to the recording sheet 42 in a transfer nip "a" of the transfer part 50*a*, where the intermediate transfer belt 21 and the pressing device 51 contact each other. Because the image 12 which has been increased in the viscosity is transferred to the recording sheet 42 in the transfer nip "a" of the transfer part 50*a*, the action of a force in the transfer nip "a" is important for achieving a good transfer of the image 12. When the intermediate transfer belt 21 and the pressing device 51 rotate such that respective circumferential moving speeds in the transfer nip "a" are substantially the same, the intermediate transfer belt 21 and the pressing device 51 are at a standstill relative to each other in the transfer nip "a", and thereby only a force caused by contact of the intermediate transfer belt 21 and the recording sheet 42 acts and a rubbing force does not act. On the other hand, when the intermediate transfer belt 21 and the pressing device 51 rotate such that respective circumferential moving speeds in the transfer nip "a" are different from each other, the pressing device 51 causes a rubbing force to act on the recording sheet 42 being conveyed along the intermediate transfer belt 21. Due to this rubbing force, the image 12 is pressed into fibers of the recording sheet 42 and thereby a good transfer of the image to the recording sheet 42 is accomplished.

In an experiment, when the intermediate transfer belt 21 and the pressing device 51 were rotated such that respective circumferential moving speeds in the transfer nip "a" are substantially the same, inferior transfer was partially observed particularly in a relatively large solid part of an image. On the other hand, when the intermediate transfer belt 21 was rotated at the circumferential speed of 100 mm/s and the pressing device 51, made of rubber and having the outer diameter of 20 mm, was rotated at a rotation speed of 100 rpm, partial inferior transfer was not observed and good transfer was achieved.

At the transfer part 50*a*, the recording sheet 42 is conveyed by a movement of the intermediate transfer belt 21, and the pressing device 51 rubs the recording sheet 42 at the side not contacting the image 12. Due to this rubbing, the contact of the recording sheet 42 and the intermediate transfer belt 21 is improved so that good transfer can be achieved. However, if the frictional force at a surface of the pressing device 51 is too strong, conveyance of the recording sheet 42 is influenced. According to an experiment, good transfer of an image and conveyance of a recording sheet was achieved when the pressing device 51 is configured so as to have a relatively small coefficient of standstill friction. In particular, a good result was obtained when a rubber roller configured to have at its surface a resin layer of a fluorine family, such as ETFE, FEP, PFA, was used for the pressing device 51. Such a resin layer may be formed on a rubber roller, for example, by coating the resin on a surface of the roller, or by providing a tube of the resin around the roller. A good result was also obtained when the pressing device 51 includes a block having a resin sheet attached at its surface.

Figure 12:
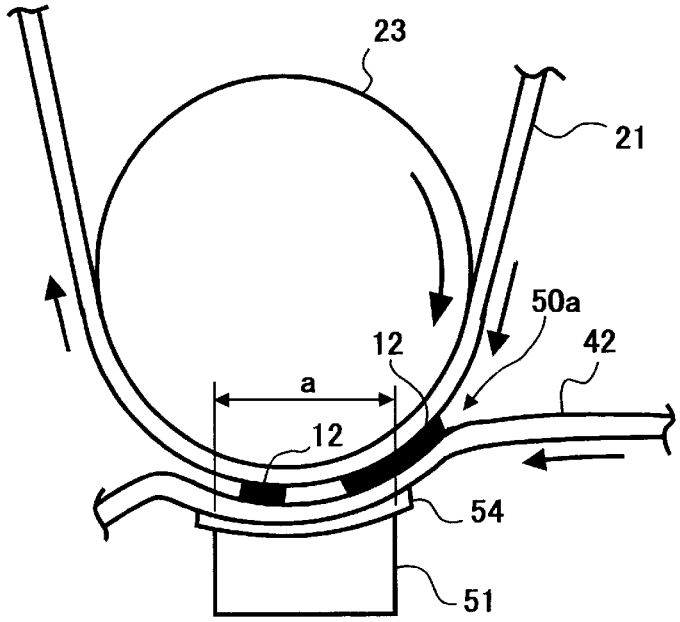
FIG. 12 is a schematic drawing for explaining another example of a transfer device according to a preferred embodiment of the present invention.

FIG. 12 is a schematic drawing for explaining another example of a transfer device according to a preferred embodiment of the present invention. Numeral 21 denotes an intermediate transfer belt, numeral 23 denotes a metal roller serving as a support roller to support the intermediate transfer belt 21, numeral 42 denotes a recording sheet, and numeral 51 denotes a pressing device. A sheet 54 is attached on the pressing device 51. The pressing device 51 is made of a sponge of EPDM, and the sheet 54 is made of EEP and has the thickness of 50 $\mu$m. Because the pressing device 51 is at a standstill, for the recording sheet 42 to be smoothly conveyed, the coefficient of friction at a contacting surface between the pressing device 51 and the recording sheet 42 must be low. Therefore, for the sheet 54, resin of a fluorine family was used.

FIG. 12 illustrates a state in which the pressing device 51 presses the recording sheet 42, and a contact part (transfer nip) of the pressing device 51 and the intermediate transfer belt 21 is indicated by "a". The pressing device 51 is formed in a rectangular parallelepiped by an EPDM sponge and is configured such that a part facing the intermediate transfer belt 21 is flat. Due to such a structure, the pressing device 51 can be manufactured relatively easily. Further, a relatively wide transfer nip is obtained, and as a result a good transfer performance is accomplished. As the pressing device 51, a sponge made of other material, such as rubber having a relatively low hardness or urethane silicone, can be also used for obtaining substantially the same effect as obtained when a sponge of EPDM is used. As the sheet 54, a sheet having a resin film of a fluorine family attached on its surface or a layer of a fluorine family coated on its surface may be also used. It is preferable that the coefficient of friction of the surface of the sheet 54 is low.

Figure 13:
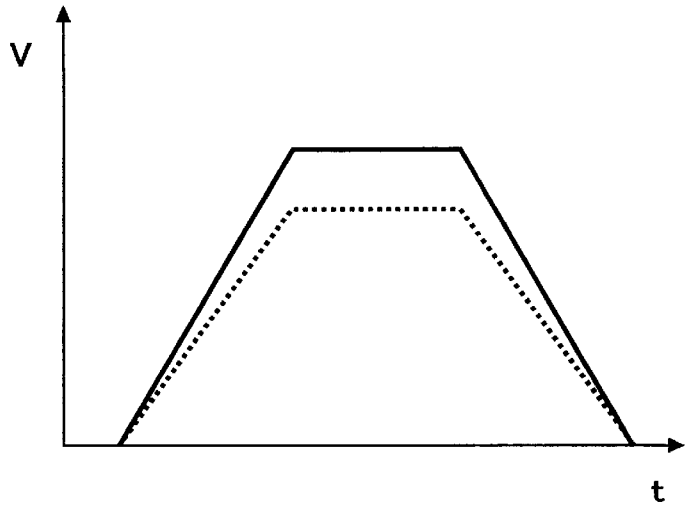
FIG. 13 is a diagram illustrating a state of the speeds of a transfer medium and a pressing device which are different in surface speeds, when the speeds are increased and decreased.

FIG. 13 is a diagram illustrating a state of the speeds of the intermediate transfer belt 21 and the pressing device 51 which are rotated at different speeds when the speeds are increased and decreased. In FIG. 13, the horizontal axis indicates a time "t" and the vertical axis indicates a linear speed "v" of each surface of the intermediate transfer belt 21 and the pressing device 51. A state of the intermediate transfer belt 21 is indicated by a solid line and that of the pressing device 51 is indicated by a dotted line. As can be understood from the diagram, the intermediate transfer belt 21 and the pressing device 51 are configured so as to move at a substantially same speed ratio at every respective speeds. The intermediate transfer belt 21 and the pressing device 51 may be configured so as to be operated by a single motor via gears, although not shown in the drawings. A speed relationship between the intermediate transfer belt 21 and the pressing device 51 which has been set when the arrangement of a row of gears is set can be always kept substantially the same so that the speed relationship is not changed, for example, when the transfer device 50 has started to operate or stopped to operate. The transfer device 50 as described above is effectively used in an image forming apparatus in which a transfer medium is intermittently driven for image transfer or a moving speed of the transfer medium is changed according to a change of the operating mode.

Figure 14A:
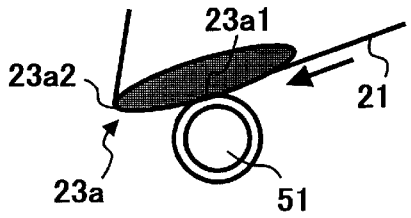
FIGS. 14(A)–14(C) are schematic drawings illustrating exemplary transfer devices according to preferred embodiments of the present invention, in which a transfer medium is supported by a same support member at both transfer and separation positions, FIG. 14(A) illustrating an example in which the support member is formed in an oval, FIG. 14(B) illustrating another example in which the support member is formed in a half-moon like shape, and FIG. 14(C) illustrating another example in which the support member is flat at the transfer position and in an acute angle at the separation position.
Figure 14B:
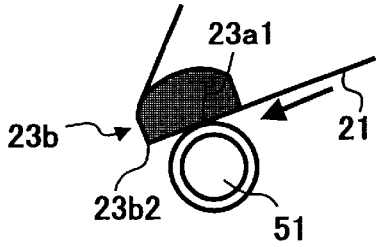
Figure 14C:
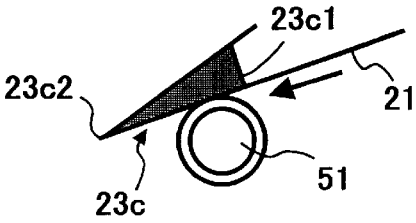

Now, other preferred embodiments of the present invention are described with reference to FIGS. 14(A)–14(C), in which the present invention is applied to a transfer device of an image forming apparatus of FIG. 1. In FIGS. 14(A)–14(C), the parts having substantially the same functions as those in FIG. 1 are denoted by the same reference numerals. FIG. 14(A) illustrates an example of the transfer device 50 in which, as the support roller 23 for supporting the intermediate transfer belt 21, a support member 23*a* formed in an oval is provided. In this example, a transfer part 23*a*1 which is shaped so as to have a relatively large radius of curvature for performing transfer of an image by contact with the transfer roller 51 and a separation part 23*a*2 which is shaped so as to have a relatively small radius of curvature for separating a recording medium from the intermediate transfer belt 21, are both formed in the same support member 23*a* formed in an oval. Thus, in the device in which transfer of an image and separation of a recording medium from the intermediate transfer belt 21 serving as a transfer medium are accomplished by the same support member 23*a*, by configuring the support member 23*a* such that a contact width of the support member 23*a* with the transfer roller 51 at the transfer part 23*a*1 is relatively wide, and at the same time, such that the radius of curvature at the transfer part 23*a*2 is minimum, transfer of an image and separation of a recording medium from the intermediate transfer belt 21 are performed in a reliable manner.

FIG. 14(B) illustrates an example of the transfer device 50 in which a support member 23*b* for supporting the intermediate transfer belt 21 is formed in a half-moon like shape. A transfer part 23*b*1 of the support member 23*b* to transfer an image by contact with the transfer roller 51 is formed in a flat shape and a separation part 23*b*2 of the support member 23*b* to separate a recording medium from the intermediate transfer belt 21 is formed in a curved shape. Thus, as illustrated in FIG. 14(B), in the device in which transfer of an image and separation of a recording medium from the intermediate transfer belt 21 are performed by the same support member 23*b*, by configuring the support member 23*b* such that the transfer part 23*b*1 of the support member 23*b* is flat for increasing a contact width with the transfer roller 51 so as to increase the transfer efficiency, and at the same time, such that the separation part 23*b*2 has a right or obtuse angle or a circular arc, transfer of an image and separation of a recording medium from the intermediate transfer belt 21 are reliably performed.

FIG. 14(C) illustrates an example of the transfer device 50 in which a transfer part of 23*c*1 of a support member 23*c* where an image is transferred by contact with the transfer roller 51 is formed in a flat shape and a separation part 23*c*2 to separate a recording medium from the intermediate transfer belt 21 is formed to have an acute angle. As illustrated in FIG. 14(C), in the device in which transfer of an image and separation of a recording medium from the intermediate transfer belt 21 are performed by the same support member 23*b*, by configuring the support member 23*c* such that the transfer part 23*c*1 of the support member 23*c* is flat for increasing the contact width with the transfer roller 51 so as to increase the transfer efficiency, and at the same time, such that the separation part 23*c*2 of the support member 23*c* is has an acute angle shape, transfer of an image and separation of a recording medium from the intermediate transfer belt 21 are performed in a reliable manner.

Figure 15A:
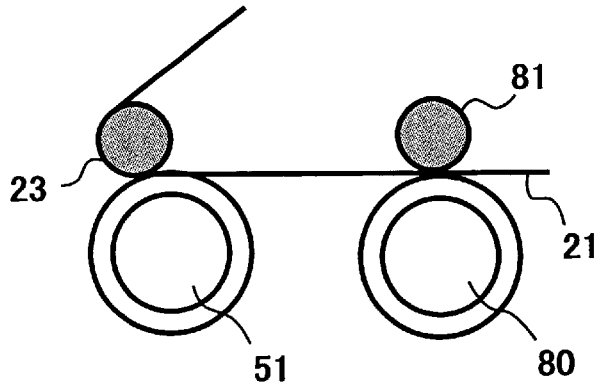
FIGS. 15(A)–15(C) are schematic drawings illustrating another exemplary transfer devices according to preferred embodiments of the present invention, in which a pressing roller functioning as a pressing device is provided for further improving the transfer performance.
Figure 15B:
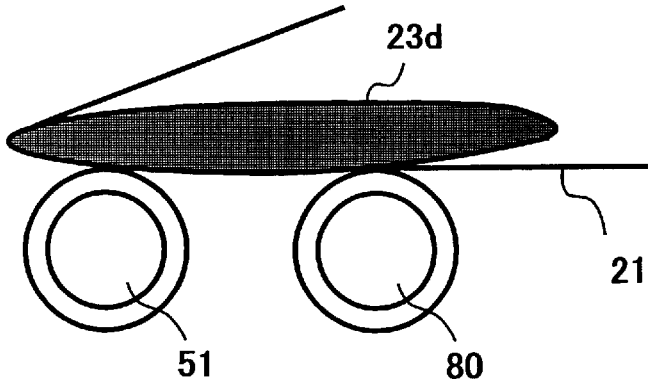
Figure 15C:
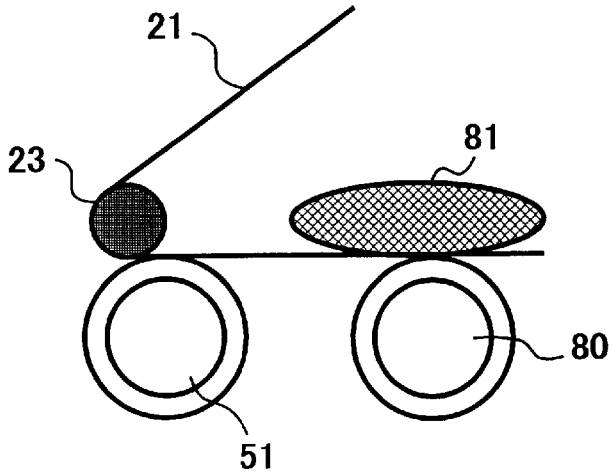

FIGS. 15(A)–15(C) are schematic drawings illustrating another examples of the transfer device 50 according to preferred embodiments of the present invention, in which, for further improving the transfer performance, in addition to the transfer roller 51, a pressing roller functioning as a pressing device to press a recording medium to the intermediate transfer belt 21 is provided.

In FIG. 15(A), a support member 23 performing separation of a recording medium from the intermediate transfer belt 21 may be configured in a substantially same manner as illustrated in any one of FIGS. 14(A)–14(C) so as to achieve a substantially same separation performance as in FIGS. 14(A)–14(C). In these examples, while transfer of an image and separation of a recording medium from the intermediate transfer belt 21 are performed by the support member 23 and the transfer roller 51, another pressing roller 80 and another support member 81 are provided so as to further improve the image transfer efficiency. Further, the pressing roller 80 is arranged such that an interval between the two pressing rollers 80 does not coincide with an integral time of an interval the intermediate transfer belt 21 is intermittently moved. Because of such an arrangement, even when a process is employed in which image writing and image transfer operations are performed at a same time, uneven transfer of an image does not occur. More specifically, when an image forming apparatus is configured such that an image forming operation by an image forming device and an image transferring operation by an image transfer device are intermittently performed at a same time, uneven transfer of an image is caused in the image due to intermittent movement of the transfer medium. That is, in an image forming operation, the transfer medium stops while the image is formed for one line, and after completion of the image for one line, the transfer medium is moved for one line for formation of a next line of the image. Therefore, during that time when the transfer medium is stopped, a same portion of an image which is being transferred to a recording medium at a transfer position of the transfer medium continues to be pressed by a pressing device for the transfer, thereby such a portion of the image is transferred differently from another portion of the image which has been transferred while the transfer medium is moving. According to the present invention, by arranging a plurality of pressing devices at an interval different from an integer times of the interval the transfer medium is intermittently conveyed, the above-described uneven transfer of an image is avoided.

In FIG. 15(A), when more than two pressing devices 80 and support members 81 are arranged, at least one of the pressing devices 80 or all of the support members 81 may be an oval, a half-circle or a polygon. Further, by configuring the support member 81 pressed by the pressing roller 80 so as to be fixed and by making the radius of curvature of the support member 81 larger than that of a transfer part of the support member 23, the contact width of the pressing roller 80 with the support member 81 is relatively large and thereby the image transfer performance is improved, and at the same time good separation of a recording medium from the intermediate transfer belt 21 is accomplished by the separation part of the support roller 23.

In FIG. 15(B), a single support member 23*d* is arranged for the transfer roller 51 and the pressing roller 80 for simplifying the construction. According to an experiment, in an image forming apparatus in which transfer of an image and separation of a recording medium from the intermediate transfer belt 21 are performed by the same support member 23*d* and in which the operation of applying the set material 11 onto the intermediate transfer belt 21 and writing an image is performed in substantially the same manner as in the other embodiments, by providing the transfer roller 51 and the pressing roller 80 against the support member 23*d* as illustrated in FIG. 15(B), a good transfer performance was obtained.

In FIG. 15(C), different support members are arranged for transfer of an image and separation of a recording medium, i.e., the support roller 23 and the support member 81, and a surface of the supporting member 81, which is pressed by the pressing roller 80 for image transfer, is formed in a flat shape. In an image forming apparatus in which transfer of an image and separation of a recording medium from the intermediate transfer belt 21 are performed by the support roller 23 and the support member 81 and in which the operation of applying the set material 11 onto the intermediate transfer belt 21 and writing an image is performed in substantially the same manner as in the other embodiments, the image transfer performance is improved by configuring the support member 81 so as to have a flat surface. At the same time, for the support member 23 used for the separation of a recording medium from the intermediate transfer belt 21, material having a relatively strong strength can be used so that durability of the device is enhanced.

Further, as illustrated in FIGS. 16(A)–16(E), the transfer device 50 may be configured, according to preferred embodiments of the present invention, such that the transfer roller 51 is not provided for pressing the support roller 23 so that the support roller 23 only performs separation of a recording medium from the intermediate transfer belt 21.

Figure 16A:
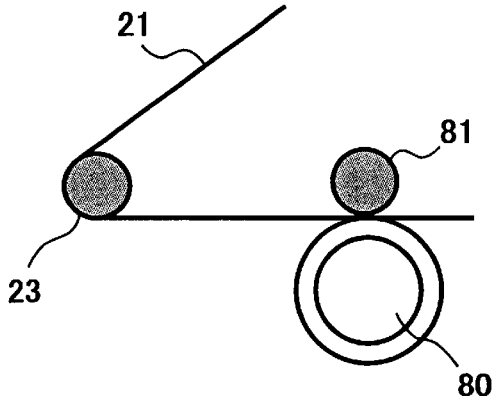
FIGS. 16(A)–16(E) are schematic drawings illustrating another exemplary transfer devices according to preferred embodiments of the present invention, in which a transfer roller is not provided at a separation position for separation of a recording medium from a transfer medium, and a transfer roller and a support member to support the transfer medium are arranged upstream of the separation position for performing transfer of an image.
Figure 16B:
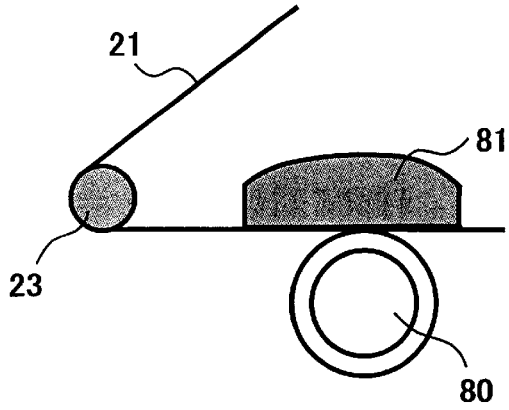
Figure 16C:
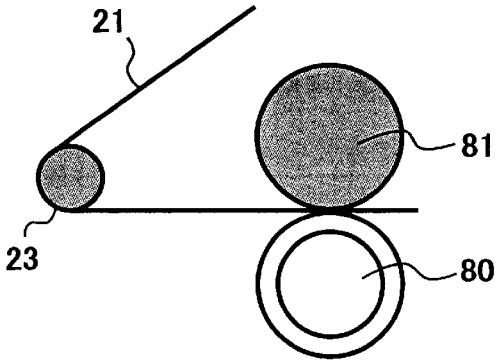

In FIGS. 16(A)–16(C), the pressing roller 80 and the support member 81 are arranged upstream of the support roller 23 for performing transfer of an image. FIG. 16(B) illustrates an example in which the support member 81 is shaped in a half-moon shape. FIG. 16(C) illustrates an example in which a roller having a relatively small radius of curvature, i.e., a roller having a small diameter, e.g., 15 mm, is used for the support member 23 so that a good separation performance is achieved, and a roller having a relatively large radius of curvature, i.e., a roller having a large diameter, e.g., 40 mm, is used for the support member 81 so that the contact width between the support member 81 and the pressing roller 80 is large. A considerably good transfer performance was achieved in an experiment made using a transfer device configured as described above.

Figure 16D:
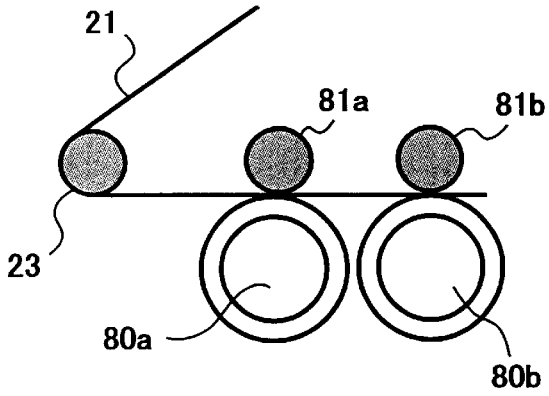

FIG. 16(D) illustrates an example in which a pressing roller for transfer of an image is arranged in more than two locations. As illustrated in FIG. 16(D), a support member 81*b* supporting the intermediate transfer belt 21 is pressed by a pressing roller 80*b* for transfer of an image and a roller-like support member 23 is provided for performing separation of a recording medium from the intermediate transfer belt 21. Further, between the support member 23 and the pressing roller 80*b*, a pressing roller 80*a* serving as a second pressing device and a support member 81*a* therefore are provided. The pressing rollers 80*a* and 80*b* are arranged at such an interval that does not coincide with an integral of an interval the intermediate transfer belt 21 is intermittently conveyed, so that occurrence of uneven transfer of an image is avoided in a case that an image writing operation and an image transfer operation are performed at a same time intermittently. For the support members 81*a* and 81*b*, support rollers having the diameter of 40 mm can be also used. Therefore, by using such rollers having a relatively large diameter, a sufficient transfer nip width can be assured, so that a good image transfer performance can be achieved and thereby a good image quality can be achieved. Further, by providing more than two pressing rollers as described above, irregular image transfer is avoided, so that an image of good quality can be obtained.

Figure 16E:
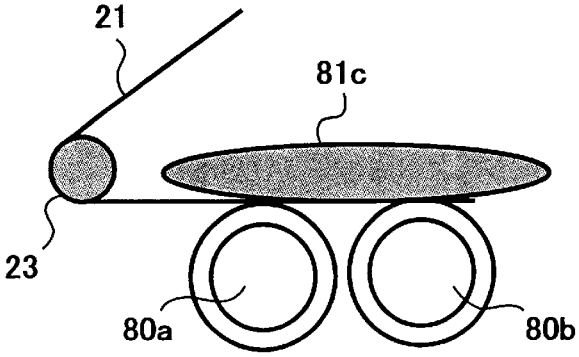

In FIG. 16(E), while a plurality of pressing rollers 80*a* and 80*b* are provided before separation of a recording medium from an intermediate transfer belt as in FIG. 16(D), a single support member 81*c* is arranged, instead of different support members, for the plurality of pressing rollers 80*a* and 80*b*. The transfer device 50 can be made simple by such a configuration.

The radius of curvature formed in the above-described intermediate transfer belt 21 serving as a transfer medium for separation of a recording medium from the intermediate transfer belt 21 is preferably between 1.25 mm and 15 mm, so that the recording medium can be securely separated from the transfer medium 21.

Further, the radius of curvature may be between about 1.25 mm and about 7 mm, so that the recording medium can be more securely separated from the transfer medium 21. Specifically, when a recording medium carries an image at a leading edge of the recording medium, the recording medium more firmly contacts the transfer medium 21 as compared when the recording medium does not carry an image at a leading edge thereof. By making the curvature of the transfer medium 21 smaller, even in such a case, the recording medium can be securely separated from the transfer medium 21. Further, when an image forming apparatus is configured such that a blank part is formed at a leading edge of a recording medium for securely separating the recording medium from the transfer medium 21, by sufficiently examining a relationship between the transfer position of the transfer medium 21 and the curvature of the transfer medium 21 at the separation position, the blank part required at a leading edge of a recording medium can made less.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications Nos. 11-367337, 2000-004019, 2000-007212, 2000-092528, 2000-107234, 2000-292891, filed in the Japanese Patent Office on Dec. 24, 1999, Jan. 12, 2000, Jan. 14, 2000, Mar. 29, 2000, Apr. 7, 2000 and Sep. 26, 2000, and the entire contents of which are hereby incorporated by reference.

What is claimed as new and is desired to be secured by Letter Patent of the United State is:

1. A method of forming an image, comprising:

forming into aggregations, a material that increases a viscosity of liquid drops by contact with the liquid drops;

adhering the aggregations of the material to a transfer medium at an aggregation interval, the aggregation interval being greater than zero;

causing a liquid drop of a diameter larger than the aggregation interval to contact the material according to an image signal, such that an image is formed with the liquid drop having been increased in viscosity by contact with the material; and transferring the image to a recording medium;

wherein the viscosity of the liquid drop when increased on the transfer medium by contact with the material is optimized such that the liquid drop adheres to the recording medium without being divided into a part remaining on the transfer medium and another part being transferred to the recording medium.

2. The method of claim 1, wherein the viscosity of the liquid drop when increased by contact with the material is between 10,000 cps (centipoise) and 200,000 cps so that the liquid drop adheres to the recording medium without being divided into a part remaining on the transfer medium and another part being transferred to the recording medium.

3. An image forming apparatus, comprising:

a transfer medium;

a material forming device configured to form into aggregations, a material that increases a viscosity of liquid drops by contact with the liquid drops, and to adhere the aggregations of the material to the transfer medium at an aggregation interval, the aggregation interval being greater than zero;

an image forming device configured to cause a liquid drop of a diameter larger than the aggregation interval to contact the material according to an image signal such that an image is formed with the liquid drop having been increased in viscosity by contact with the material; and a transfer device configured to transfer the image to a recording medium;

wherein the viscosity of the liquid drop when increased on the transfer medium by contact with the material is optimized such that the liquid drop adheres to the recording medium without being divided into a part remaining on the transfer medium and another part being transferred to the recording medium.

4. The image forming apparatus of claim 3, wherein the material forming device includes:

concave surfaces, facing the transfer medium, that form the aggregations by containing the material.

5. The image forming apparatus of claim 4, wherein the material is a powder.

6. The image forming apparatus of claim 4, wherein the aggregation forming device includes a urethane sponge.

7. The image forming apparatus of claim 4, wherein a diameter of the concave surface is about 20 $\mu$m.

8. The image forming apparatus of claim 4, further comprising: a device, arranged in a vicinity of the aggregation forming device, configured to make the aggregations uniform.

9. An image transfer device for an image forming apparatus including a transfer medium feeding device configured to feed a transfer medium, a material forming device configured to form into aggregations, a material that increases a viscosity of liquid drops by contact with the liquid drops, and to adhere the aggregations of the material to the transfer medium at an aggregation interval, the aggregation interval being greater than zero, and an image forming device configured to cause a liquid drop of a diameter larger than the aggregation interval to contact the material according to an image signal such that an image is formed with the liquid drop having been increased in viscosity by contact with the material, the image transfer device comprising:

a pressing device configured to press a recording medium into contact with the transfer medium such that the image is transferred to the recording medium; and at least one motor configured to drive the pressing device and the transfer medium feeding device such that a surface of the transfer medium and a surface of the pressing device are moved at different speeds so the pressing device causes a rubbing force to act on the recording medium thereby pressing the image into fibers of the transfer medium, wherein the recording medium is moved by movement of the transfer medium, and wherein the viscosity of the liquid drop when increased on the transfer medium by contact with the material is optimized such that the liquid drop adheres to the recording medium without being divided into a part remaining on the transfer medium and another part being transferred to the recording medium.

10. The image transfer device of claim 9, wherein a surface of the pressing device, which contacts the recording medium, includes fluorine resin.

11. An image forming apparatus, comprising:

a transfer medium;

a material forming device configured to form into aggregations, a material that increases a viscosity of liquid drops by contact with the liquid drops, and to adhere the aggregations of the material to the transfer medium at an aggregation interval, the aggregation interval being greater than zero;

an image forming device configured to cause a liquid drop of a diameter larger than the aggregation interval to contact the material according to an image signal such that an image is formed with the liquid drop having been increased in viscosity by contact with the material; and a transfer device including a pressing device configured to press a recording medium into contact with the transfer medium such that the image is transferred to the recording medium;

wherein a surface of the transfer medium and a surface of the pressing device are moved at different speeds; and wherein the recording medium is moved by movement of the transfer medium.

12. The image forming apparatus of claim 11, wherein a surface of the pressing device, which contacts the recording medium, includes fluorine resin.

13. The image forming apparatus of claim 11, wherein the pressing device rotates in a substantially same direction as the transfer medium when transferring the image.

14. A method of forming an image, comprising:

a) forming into aggregations, a material that increases a viscosity of liquid drops by contact with the liquid drops;

b) adhering the aggregations of the material to a transfer medium at an aggregation interval, the aggregation interval being greater than zero;

c) causing a liquid drop of a diameter larger than the aggregation interval to contact the material according to an image signal such that an image is formed with the liquid drop having been increased in viscosity by contact with the material; and d) transferring the image to a recording medium brought in contact with the transfer medium by pressing the recording medium with a pressing device, the transferring including:

1) moving respective surfaces of the transfer medium and the pressing device at different speeds; and 2) moving the recording medium by movement of the transfer medium.

15. A method of transferring an image formed in an image forming apparatus by forming into aggregations, a material that increases a viscosity of liquid drops by contact with the liquid drops, adhering the aggregations of the material to a transfer medium at an aggregation interval that is greater than zero, and causing a liquid drop of a diameter larger than the aggregation interval to contact the material according to an image signal such that the image is formed with the liquid drop having been increased in viscosity by contact with the material, the method comprising:

moving a recording medium by movement of the transfer medium;

bringing the recording medium into contact with the transfer medium; and pressing the recording medium with a pressing device to transfer the image to the recording medium, the pressing including moving respective surfaces of the transfer medium and the pressing device at different speeds.

16. An image forming apparatus, comprising:

a transfer medium;

means for forming into aggregations, a material that increases a viscosity of liquid drops by contact with the liquid drops, and for to adhering the aggregations of the material to the transfer medium at an aggregation interval, the aggregation interval being greater than zero;

means for causing a liquid drop of a diameter larger than the aggregation interval to contact the material according to an image signal such that an image is formed with the liquid drop having been increased in viscosity by contact with the material; and means for transferring the image to a recording medium;

wherein the viscosity of the liquid drop when increased on the transfer medium by contact with the material is optimized such that the liquid drop adheres to the recording medium without being divided into a part remaining on the transfer medium and another part being transferred to the recording medium.

17. An image transfer device for an image forming apparatus having feeding means for transferring a transfer medium, means for forming into aggregations, a material that increases a viscosity of liquid drops by contact with the liquid drops, and for adhering the aggregations of the material to a transfer medium of the image transfer device at an aggregation interval that is greater than zero, and means for causing a liquid drop of a diameter larger than the aggregation interval to contact the material according to an image signal such that an image is formed with the liquid drop having been increased in viscosity by contact with the material, the image transfer device comprising:

means for pressing a recording medium into contact with the transfer medium such that the image is transferred to the recording medium; and at least one means for driving the pressing means and the feeding mean such that a surface of the transfer medium and a surface of the pressing means are moved at different speeds so the pressing means causes a rubbing force to act on the recording medium thereby pressing the image into fibers of the transfer medium, wherein the recording medium is moved by movement of the transfer medium.

18. An image forming apparatus, comprising:

a transfer medium;

means for forming into aggregations, a material that increases a viscosity of liquid drops by contact with the liquid drops, and for adhering the aggregations of the material to the transfer medium at an aggregation interval, the aggregation interval being greater than zero;

means for causing a liquid drop of a diameter larger than the aggregation interval to contact the material according to an image signal such that an image is formed with the liquid drop having been increased in viscosity by contact with the material; and means for pressing a recording medium into contact with the transfer medium such that the image is transferred to the recording medium;

wherein a surface of the transfer medium and a surface of the pressing means are moved at different speeds; and wherein the recording medium is moved by movement of the transfer medium.

* * * * *